US008857168B2

(12) United States Patent
Opdenbosch

(10) Patent No.: US 8,857,168 B2
(45) Date of Patent: Oct. 14, 2014

(54) OVERRUNNING PUMP PROTECTION FOR FLOW-CONTROLLED ACTUATORS

(75) Inventor: Patrick Opdenbosch, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 816 days.

(21) Appl. No.: 13/088,975

(22) Filed: Apr. 18, 2011

(65) Prior Publication Data

US 2012/0260641 A1 Oct. 18, 2012

(51) Int. Cl.

| | |
|---|---|
| ***F16D 31/02*** | (2006.01) |
| ***F15B 13/043*** | (2006.01) |
| ***E02F 9/22*** | (2006.01) |
| ***F15B 7/00*** | (2006.01) |
| *F15B 11/00* | (2006.01) |

(52) U.S. Cl.

CPC ..... *E02F 9/2217* (2013.01); *E02F 9/226* (2013.01); *F15B 2211/27* (2013.01); *F15B 2211/613* (2013.01); *E02F 9/2296* (2013.01); *F15B 2211/761* (2013.01); *E02F 9/2289* (2013.01); *E02F 9/2267* (2013.01); *F15B 2211/20553* (2013.01); *F15B 7/006* (2013.01); *E02F 9/2292* (2013.01); *F15B 11/003* (2013.01); *F15B 2211/3058* (2013.01); *F15B 2211/50527* (2013.01)

USPC ..... 60/414; 60/464; 60/476; 91/437

(58) Field of Classification Search

USPC ..... 60/414, 464, 468, 473, 476; 91/436, 91/437, 438, 439, 440

See application file for complete search history.

(56) References Cited

U.S. PATENT DOCUMENTS

| | | | | |
|---|---|---|---|---|
| 4,359,931 | A | 11/1982 | Palmersheim et al. | |
| 5,329,767 | A | 7/1994 | Hewett | |
| 5,415,076 | A | 5/1995 | Krone et al. | |
| 6,418,715 | B1 * | 7/2002 | Huber | 91/437 |
| 7,516,613 | B2 | 4/2009 | Kadlicko | |
| 7,827,787 | B2 * | 11/2010 | Cherney et al. | 60/414 |
| 8,033,107 | B2 * | 10/2011 | Tikkanen | 60/464 |
| 8,453,441 | B2 * | 6/2013 | Williamson et al. | 60/476 |
| 2003/0159577 | A1 | 8/2003 | Pfaff et al. | |
| 2004/0021103 | A1 | 2/2004 | Yang et al. | |

(Continued)

FOREIGN PATENT DOCUMENTS

| | | | |
|---|---|---|---|
| WO | 96/27051 | A1 | 9/1996 |
| WO | 2009/102740 | A2 | 8/2009 |
| WO | 2010-054155 | | 5/2010 |

OTHER PUBLICATIONS

Wang et al., "A hydraulic circuit with dynamical compensations," Institute for Fluid Power Education, 52nd National Conference on Fluid Power (IFPE 2011), Session 19.3, 529-538 (Las Vegas, Nevada, USA, Mar. 24, 2011).

(Continued)

*Primary Examiner* — Michael Leslie
(74) *Attorney, Agent, or Firm* — Leydig, Voit & Mayer

(57) ABSTRACT

A hydraulic system includes an actuator, a pump, rod side and cap side fluid connections between the pump and the rod and cap side chambers, respectively, at least one selectively actuatable regeneration valve that selectively provides flow from the cap side fluid connection to the rod side fluid connection, and a controller. The controller controls the pump to selectively vary the flow rate of the pump in response to a commanded motion to control movement of the piston. The controller actuates the regeneration valve during a retraction of the piston into the cylinder when pump is acting as a motor.

20 Claims, 11 Drawing Sheets

(56) References Cited

U.S. PATENT DOCUMENTS

| | | | |
|---|---|---|---|
| 2004/0055453 | A1 | 3/2004 | Tabor |
| 2005/0211936 | A1 | 9/2005 | Tabor et al. |
| 2006/0090460 | A1 | 5/2006 | Ma et al. |
| 2008/0034853 | A1 | 2/2008 | Tabor et al. |
| 2008/0110166 | A1 | 5/2008 | Stephenson et al. |
| 2008/0295508 | A1 | 12/2008 | Ma et al. |
| 2009/0165450 | A1 | 7/2009 | Cherney et al. |
| 2010/0115936 | A1 | 5/2010 | Williamson et al. |

OTHER PUBLICATIONS

Williamson et al., "Stability and motion control of inertial loads with displacement controlled hydraulic actuators," Proceedings of the 6th Fluid Power Network International (FPNI) Ph.D. Symposium (West Lafayette, Indiana, USA, Jun. 15-19, 2010).

Grabbel et al., "An investigation of swash plate control concepts for displacement controlled actuators," International Journal of Fluid Power, 6 (2): 19-36 (TuTech Innovation GmbH, Hamburg, Germany, Aug. 2005).

* cited by examiner

OVERRUNNING PUMP PROTECTION FOR FLOW-CONTROLLED ACTUATORS

TECHNICAL FIELD

This patent disclosure relates generally to a hydraulic circuit for a double acting actuator, and, more particularly to arrangements for protecting a pump during overrun in a system including a displacement-controlled actuator.

BACKGROUND

So-called meterless hydraulic control circuits control the motion of a hydraulic actuator by controlling a flow from one chamber of the actuator to the other utilizing one or more pumps, that is, flow rate from the pump(s) is used to control the flow to and/or from the chambers of the actuator, as opposed to utilizing proportional valves. In metered systems, proportional or throttling valves are utilized to restrict or meter the fluid flow therethrough to control movement of the actuator. In contrast, in meterless systems, the pump(s) may be of a variable displacement type or of a fixed displacement type wherein the flow from the pump to the actuator chambers is varied in order to control the speed of the actuator movement.

In viewing the structure of an actuator, a rod extends from the one side of the piston and outward from the cylinder. As a result, the area of the piston on the side from which the rod extends is less than the area of the piston on the cap side of the actuator. Accordingly, the volumes of fluid displaced from the rod chamber and the cap side chamber differ. When extending the actuator, a supplemental volume of fluid is required in addition to the fluid displaced from the rod chamber. Conversely, when the actuator is retracted, the rod chamber cannot accommodate all of the fluid displaced from the cap side chamber. As a result, the hydraulic control circuits of this architecture include make-up circuits which provide and receive this excess hydraulic fluid.

In executing commanded motions that are in the opposite direction of the force applied by the load on the actuator, the pump acts as a pump, pumping fluid from one chamber to the other. Conversely, in executing commanded motions that are in the same direction the force applied by the load on the actuator, the load force acts to "push" the fluid from one chamber to the other such that the pump typically acts as a motor. In a motoring retraction, however, the volume of fluid flowing from the cap side chamber can be beyond the capabilities of the pump and driver, causing the pump to overspeed. Overspeeding can result in overheating the pump, or early pump failure if the pump is not adequately sized, which can result in higher costs.

One such meterless hydraulic control circuit is shown, for example, in U.S. Publication 2009/0165450. In this arrangement, two proposals are made for accommodating the excess fluid in a motoring retraction. In a first arrangement, fluid from the cap side chamber is directed through the pump and to the rod chamber; valves may be opened to direct a portion of the flow from the cap side chamber or the pump directly to the tank. In a second arrangement, all fluid from the cap side chamber is directed to the tank, and then fluid is pumped from the tank directly to the rod chamber.

SUMMARY

The disclosure describes, in one aspect, a hydraulic system having an actuator having a piston disposed within a cylinder, and a rod extending from the piston and extending out of the cylinder, the piston defining a rod chamber and a cap side chamber within the cylinder, a pump, a rod side fluid connection between the pump and the rod chamber, and a cap side fluid connection between the pump and the cap side chamber. The pump is adapted to operate as a pump or as a motor, and to selectively provide varied flow rates. The pump is further adapted to selectively deliver pressurized hydraulic fluid to and receive pressurized hydraulic fluid from the chambers of the actuator. Movement of the piston relative to the cylinder is dependent upon the selectively varied flow rates. At least one selectively actuatable regeneration valve is disposed to selectively provide flow from the cap side fluid connection to the rod side fluid connection. A controller controls the selectively varied flow rate of the pump in response to a commanded motion and relative positions of the piston and cylinder. The controller is configured to cause the actuation of the regeneration valve during a retraction of the piston into the cylinder when pump is acting as a motor.

In another aspect, the disclosure describes a hydraulic system having an actuator having a piston disposed within a cylinder, and a rod extending from the piston and extending out of the cylinder, the piston defining a rod chamber and a cap side chamber within the cylinder, a pump, a rod side fluid connection between the pump and the rod chamber, and a cap side fluid connection between the pump and the cap side chamber. Again, the pump is adapted to operate as a pump or as a motor. The pump is further adapted to selectively provide varied flow rates and to selectively deliver pressurized hydraulic fluid to and receive pressurized hydraulic fluid from the chambers of the actuator. Movement of the piston relative to the cylinder is dependent upon the selectively varied flow rates. At least one selectively actuatable regeneration valve is disposed to selectively provide flow from the cap side fluid connection to the rod side fluid connection. The regeneration valve includes at least a first position in which fluid is substantially prevented from passing through the regeneration valve, and a second position wherein the regeneration valve provides a fluid connection between the cap side fluid connection and the rod side fluid connection. A controller controls the selectively varied flow rate of the pump in response to a commanded motion and relative positions of the piston and cylinder. The controller is configured to cause the actuation of the regeneration valve during a retraction of the piston into the cylinder when pump is acting as a motor. At least one selectively actuatable cross-over relief valve is disposed to selectively provide flow from at least one of the cap side fluid connection to the rod side fluid connection and the rod side fluid connection to the cap side fluid connection. The cross-over relief valve is actuatable to provide flow from the cap side fluid connection to the rod side fluid connection in response to a minimum fluid pressure of hydraulic fluid flow within the cap side fluid connection, and actuatable to provide flow from the rod side fluid connection to the cap side fluid connection in response to a minimum pressure of hydraulic fluid flow within the rod side fluid connection. A hydraulic fluid source and a makeup hydraulic circuit are disposed to provide selective flow between the cap side fluid connection and the hydraulic fluid source, and between the rod side fluid connection and the hydraulic fluid source.

According to another aspect of the disclosure, there is described method of controlling a hydraulic system including an actuator having a piston disposed within a cylinder, and a rod extending from the piston and extending out of the cylinder, the piston defining a rod chamber and a cap side chamber within the cylinder, a pump for delivering pressurized fluid to and receiving pressurized fluid from the chambers of the actuator, a rod side fluid connection between the pump and the rod chamber, and a cap side fluid connection between the pump and the cap side chamber. The method includes the step of disposing at least one regeneration valve between the cap side fluid connection and the rod side fluid connection. The regeneration valve is movable between at least a first position wherein flow through the valve is substantially prevented, and a second position wherein flow is permitted from the cap side fluid connection to the rod side fluid connection. The method further includes the steps of controlling the flow rate of the pump in response to relative positions of the piston and cylinder and a commanded motion of the actuator, and actuating the regeneration valve to move to its second position only when a retraction of the actuator is commanded and the pump is acting as a motor.

Another aspect of the disclosure describes a method of controlling a hydraulic system including an actuator having a piston disposed within a cylinder, and a rod extending from the piston and extending out of the cylinder, the piston defining a rod chamber and a cap side chamber within the cylinder, a pump for delivering pressurized fluid to and receiving pressurized fluid from the chambers of the actuator, the pump being adapted to operate as a pump or a motor, a rod side fluid connection between the pump and the rod chamber, and a cap side fluid connection between the pump and the cap side chamber. The method includes the step of disposing at least one regeneration valve between the cap side fluid connection and the rod side fluid connection. The regeneration valve is movable between at least a first position wherein flow through the valve is substantially prevented, and a second position wherein flow is permitted from the cap side fluid connection to the rod side fluid connection. The method further includes the steps of controlling the flow rate of the pump in response to relative positions of the piston and cylinder and a commanded motion of the actuator, operating the pump as a pump when an extension of the actuator is commanded and a force exerted by a load is in the opposite direction of the commanded extension, operating the pump as a motor when an extension of the actuator is commanded and the force exerted by the load is in the same direction as the commanded retraction, operating the pump as a pump when a retraction of the actuator is commanded and the force exerted by the load is in the opposite direction of the commanded extension, operating the pump as a motor when a retraction of the actuator is commanded and a force exerted by a load is in the same direction as the commanded retraction, and actuating the regeneration valve to move to its second position only when the retraction of the actuator is commanded and the pump is acting as a motor.

BRIEF DESCRIPTION OF THE DRAWING(S)

DETAILED DESCRIPTION

Figure 1:
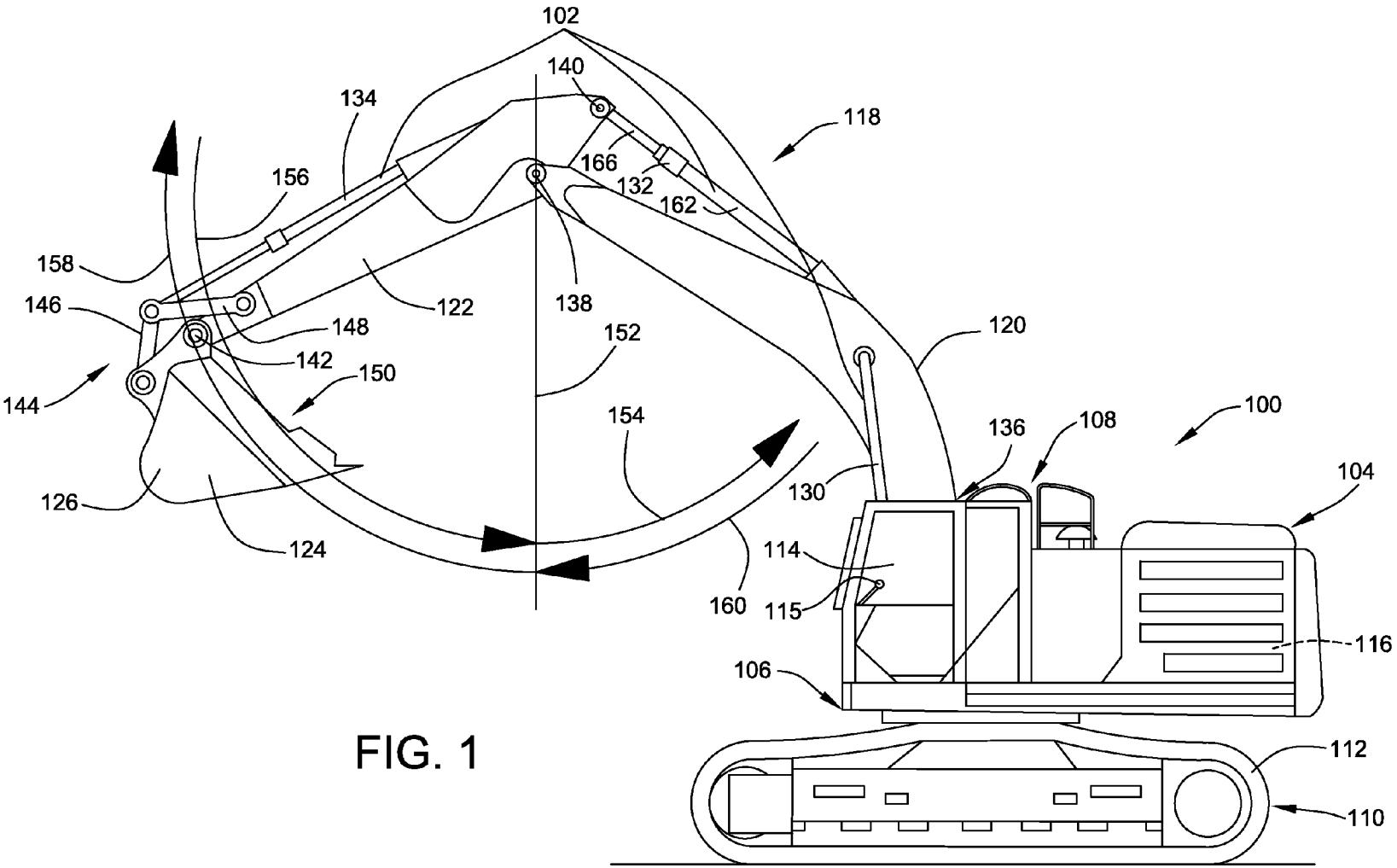
FIG. 1 is a side elevational view of a machine incorporating aspects of this disclosure.

This disclosure relates to machines 100 that utilize hydraulic actuators (identified generally as 102) to control movement of moveable subassemblies of the machine, such as arms, booms, implement tools, or the like. More specifically, the disclosure relates to such hydraulic systems 104 utilized in machines 100, such as the excavator 106 illustrated in FIG. 1, used to control extension and retraction of such hydraulic actuators 102. While the arrangement is illustrated in connection with an excavator 106, the arrangement disclosed herein has universal applicability in various other types of machines 100 as well. The term "machine" may refer to any machine that performs some type of operation associated with an industry such as mining, construction, farming, transportation, or any other industry known in the art. For example, the machine may be a wheel loader or a skid steer loader. Moreover, one or more implement tools may be connected to the machine 100. Such implement tools may be utilized for a variety of tasks, including, for example, brushing, compacting, grading, lifting, loading, plowing, ripping, and include, for example, augers, blades, breakers/hammers, brushes, buckets, compactors, cutters, forked lifting devices, grader bits and end bits, grapples, blades, rippers, scarifiers, shears, snow plows, snow wings, and others.

The excavator 106 of FIG. 1 includes a cab 108 that is swingably supported on an undercarriage 110 that includes a pair of rotatably mounted tracks 112. The cab 108 includes an operator station 114, which includes an operator control 115. The operator control 115 may be of any appropriate design. By way of example only, the operator control 115 may be in the form of joystick, such as illustrated in FIG. 1, a dial, a switch, a lever, a combination of the same, or any other arrangement that provides the operator with a mechanism by which to identify the movement commanded. The cab 108 may further include an engine 116, and at least a portion of the hydraulic system 104. The engine 108 may be an internal combustion engine or any type power source known to one skilled in the art now or in the future.

A front linkage 118 includes a boom 120 that is pivotably supported on the cab 108, a stick 122 pivotably coupled to the boom 120, and an implement tool 124 pivotably coupled to the stick 122. While the implement tool 124 is illustrated as a bucket 126, the implement tool 124 may alternately be, for example, a compactor, a grapple, a multi-processor, thumbs, a rake, a ripper, or shears.

Movement of the boom 120, stick 122, and implement tool 124 is controlled by a number of actuators 130, 132, 134. The boom 120 is pivotably coupled to cab 108 at one end 136. To control movement of the boom 120 relative to the cab 108, a pair of actuators 130 are provided on either side of the boom 120, coupled at one end to the cab 108, and at the other end to the boom 120.

The stick 122 is pivotably coupled to the boom 120 at a pivot connection 138. Movement of the stick 122 relative to the boom 120 is controlled by the actuator 132 that is coupled at one end to the boom 120, and at the other end to the stick 122. The actuator 132 is pivotably coupled to the stick 122 at a pivot connection 140 that is spaced from the pivot connection 138 such that extension and retraction of the actuator 132 pivots the stick 122 about pivot connection 138.

The implement tool 124 is pivotably coupled to the stick 122 at pivot connection 142. Movement of the implement tool 124 relative to the stick 122 is controlled by actuator 134. The actuator 134 is coupled to the stick 122 at one end. The other end of the actuator 134 is coupled to a four-bar linkage arrangement 144 that includes a portion of the stick 122 itself, as well as the implement tool 124 and a pair of links 146, 148.

Turning more particularly to the movement of the stick 122 relative to the boom 120, and the operation of the actuator 132, it will be appreciated by those of skill in the art that movement of the stick 122 relative to the boom 120 may be divided into four quadrants that are defined by the force of the load and the commanded direction of movement. The load may be defined as including not only the implement tool 124, but also any cargo carried within the implement tool 124, and the stick 122 insofar as it is not balanced in its weight distribution about pivot connection 138. For illustration purposes, the load is identified generally as 150 in FIG. 1. The lowermost equilibrium position (identified as 152 in FIG. 1) of the load 150 is illustrated as directly below the pivot connection 138 for the purposes of this explanation, although it may alternately be off centered, depending upon the center of gravity of the stick 122, implement tool 124, and cargo carried in the implement tool 124.

When a command is given to pivot the stick 122 inward toward the cab, the actuator 132 is extended, causing the stick 122 to pivot counterclockwise in the illustrated embodiment. More specifically, when a command is given to pivot the stick 122 from the position illustrated in FIG. 1 to the position identified as 152, the commanded motion is in the same direction as the force of the load 150, that is, along the arc identified as 156. With the load 150 at the lowermost equilibrium position 152, when a command is issued to move the implement tool 124 further toward the cab 108, the actuator 132 continues to extend to pivot the stick 122, now against the force of the load 150, moving the implement tool 124 along the arc identified as 154.

Conversely, when a command is provided to pivot the stick 122 outward from the cab 108, the actuator 132 is retracted to pivot the stick 122 in a clockwise direction. More specifically, when the load 150 is in the lower most equilibrium position 152 as identified in FIG. 1, when a retraction of the actuator 132 is commanded, the implement tool 124 moves along the arc identified as 158 in FIG. 1. In this condition, the retracting movement of the actuator 132 is against the force of the load 150. Finally, when a command is given to pivot the stick 122 outward along the arc identified as 160, the actuator 132 retracts, as the commanded motion is in the same direction as the force of the load 150.

Figure 2:
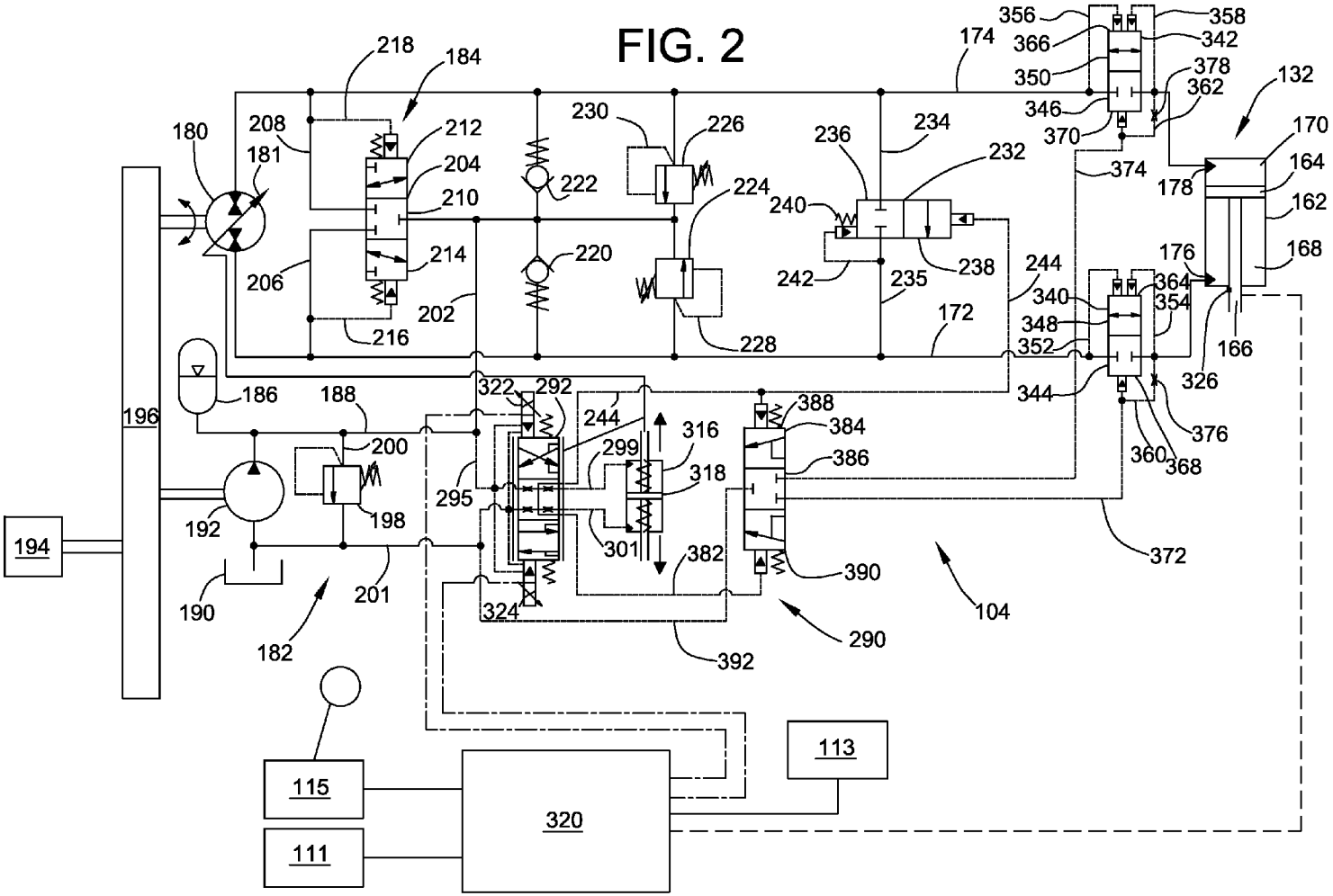
FIG. 2 is a schematic view of a hydraulic system according to this disclosure.

Movement of the actuator 132 is controlled by the hydraulic system 104, which is shown in greater detail in FIG. 2. While the explanation of the hydraulic system 104 is explained below with regard to actuator 132, the explanation is equally applicable to the other actuators 130, 134, as well as any actuator operated by a similar so-called "meterless" hydraulic system 104.

The actuator 132 includes a cylinder 162 in which a piston 164 is slidably disposed. A rod 166 is secured to the piston 164, and extends from the cylinder 162. In this way, the piston 164 divides the interior of the cylinder 162 into a rod chamber 168 and a cap side chamber 170. In operation, as the actuator 132 is extended, hydraulic fluid flows from the rod chamber 168 and hydraulic fluid flows into the cap side chamber 170 as the piston 164 and rod 166 slide within the cylinder 162 to telescope the rod 166 outward from the actuator 132. Conversely, as the actuator 132 is retracted, hydraulic fluid flows into the rod chamber 168 and hydraulic fluid flows out of the cap side chamber 170 as the piston 164 and rod 166 slide within the cylinder 162 to retract the rod 166 into the cylinder 162. Flow of hydraulic fluid to and from the rod and cap side chambers 168, 170 proceeds through a rod side fluid connection 172 and a cap side fluid connection 174, respectively, that are fluidly coupled to respective ports 176, 178 opening in the rod or cap side chambers 168, 170 in the cylinder 162.

Flow between the rod and cap side chambers 168, 170 through the rod side and cap side fluid connections 172, 174 is provided by a pump 180 wherein the flow rate from the pump may be varied. In this way the pump 180 controls the operation of actuator 132, rather than so-called metering valves. The illustrated pump 180 is a variable displacement pump 180, which includes a swash plate 181, the angle of which determines the positive or negative displacement of the pump 180, and volume of flow from the pump 180. It will thus be appreciated that the displacement of the pump 180, and, accordingly, the flow rate is controlled in order to control both the direction and volume of the flow of hydraulic fluid to provide extension and retraction of the actuator 132 as commanded by the operator. While a pump 180 is illustrated, the pump 180 may alternately be a fixed displacement pump wherein the speed may be varied by an associated driving motor.

The pump 180 may operate as a pump to positively pump fluid from one fluid connection 172, 174 to the other 172, 174, or a motor as fluid flows from one fluid connection 172, 174 to the other 172, 174. More specifically, as an extension or a retraction of the actuator 132 is commanded against the force of the load 150, as along the arcs identified as 154 or 158, respectively, in FIG. 1, the pump 180 acts as a pump, pumping hydraulic fluid from one chamber 168, 170 to the other 168, 170. Conversely, when an extension or a retraction of the actuator 132 is commanded in the same direction as the force of the load 150, as in the arcs identified as 156 or 160, respectively, in FIG. 1, the force of the load 150 causes a movement of fluid from one chamber 168, 170 to the other 168, 170 such that the energy of fluid motion allows the pump 180 to be operated as a motor. The flow of hydraulic fluid to and from the chambers 168, 170 as the stick 122 and implement tool 124 move along the arcs 154, 156, 158, 160 are illustrated by arrows in FIGS. 3-6, respectively.

It will be appreciated by those of skill in the art that the respective volumes of hydraulic fluid flowing into and out of the rod and cap side chambers 168, 170 during extension and retraction of the actuator 132 are not equal. This is a result of the difference in surface area of the piston 164 on the rod and cap side chambers 168, 170, that is, the surface area of the piston 164 where the rod 166 extends from the piston 164 is less than the surface area of the piston 164 facing the cap side chamber 170. Consequently, during retraction of the actuator 132, more hydraulic fluid flows from the cap side chamber 170 than can be utilized in the rod chamber 168. Conversely, during extensions of the actuator 132, additional hydraulic fluid is required to supplement the hydraulic fluid flowing from the rod chamber 168 in order to fill the cap side chamber 170. To receive this excess hydraulic fluid and provide this supplemental hydraulic fluid, a charge circuit 182 and make-up hydraulic circuit 184 are provided, as shown in FIGS. 2-6.

The charge circuit 182 includes at least one hydraulic fluid source, two of which are provided in the illustrated embodiment. The illustrated charge circuit 182 includes an accumulator 186 that may be utilized to provide a source of pressurized hydraulic fluid or that may be charged with excess hydraulic fluid through a charge conduit 188. The illustrated charge circuit 182 additionally includes a tank 190 from which hydraulic fluid may be provided by a second pump 192 through the charge conduit 188. Excess hydraulic fluid, either from the second pump 192 or operation of the actuator 132 may be returned to either the accumulator 186, or to the tank 190 by way of a charge pilot valve 198 disposed in a charge pilot conduit 200, which is fluidly connected to return conduit 201. The charge pilot valve 198 is operated as a result of fluid pressure in the conduit 200 along the inlet side of the charge pilot valve 198, although an alternate method of operation may be provided. In this embodiment, the pump 180 and the second pump 192 are both operated by a prime mover 194, such as the engine 116, through a gearbox 196. In an alternate embodiment, one or both of the pumps 180, 192 may connected directly to the engine 116 or prime mover 194 shaft with no speed ratio change. The pump 180 and/or the second pump 192 may alternately be operated by a battery or other power storage arrangement. It will further be appreciated that the second pump 192 may be selectively operated, or continuously operated, as in the illustrated embodiment, depending upon the arrangement provided.

The make-up hydraulic circuit 184 includes a make-up conduit 202 that is fluidly coupled to the charge conduit 188, a make-up valve 204, a rod side make-up conduit 206 and a cap side make-up conduit 208, which are fluidly coupled to the rod side fluid connection 172 and the cap side fluid connection 174, respectively. The make-up valve 204 has three positions. The first, central default position 210 prevents flow to or from each of conduits 202, 206, 208. Alternatively, the central default position may be constructed such that conduit 208 is connected to conduit 202 by an orifice (not shown), and conduit 206 is connected to conduit 202 by an orifice (not shown); this connection using orifices may be desirable if the pump 180 does not return to a perfect zero displacement when commanded to neutral. For the purposes of this disclosure, however, any reference to the central default position 210 being considered a no-flow position is intended to include both illustrated design wherein no connections is made, and a situation wherein orifices are disposed between the conduits 208, 206 and the conduit 202 to severely limit any flow therethrough. The second position 212 fluidly couples the make-up conduit 202 and the rod side make-up conduit 206 to allow flow therethrough, and prevent flow to or from the cap side make-up conduit 208. The third position 214 fluidly couples the make-up conduit 202 and the cap side make-up conduit 208 to allow flow therethrough, and prevent flow to or from the rod side make-up conduit 206.

In order to operate the make-up valve 204, pilot connections 216, 218 are provided from the rod and cap side make-up conduits 206, 208, respectively. Thus, the make-up valve 204 is operative as a result of a minimum pressure differential between the pilot connections 216, 218. While very little flow occurs through the pilot connections 216, 218, it will be appreciated that the pressure from the rod side fluid connection 172 is applied to the pilot connection 216 by way of the rod side make-up conduit 206. Similarly, the pressure from the cap side fluid connection 174 is applied to the pilot connection 218 by way of the cap side make-up conduit 208.

Referring to FIGS. 3-6, the high pressure side is indicated in heavier lines for ease of explanation only. When the pressure on the cap side pilot connection 218 is sufficiently greater than the pressure on the rod side pilot connection 216, as in FIGS. 3 and 6, the make-up valve 204 will move to its second position 212. Conversely, when the pressure on the rod side pilot connections 216 is sufficiently greater than the pressure on the cap side pilot connection 218, as in FIGS. 4 and 5, the make-up valve 204 will move to its third position 214. In this way, when the pressure in the cap side fluid connection 174 is sufficiently greater than the pressure in the rod side fluid connection 172, as in FIGS. 3 and 6, the make-up valve 204 moves to its second position 212, while when the pressure in the rod side fluid connection 172 is sufficiently greater than the pressure in the rod side fluid connection 172, as in FIGS. 4 and 5, the make-up valve 204 moves to its third position 214.

It will be noted that the make-up circuit 184 may include additional valving arrangements. By way of example, the make-up circuit 184 may include check valves 220, 222 that are operative at set pressure differentials between the make-up conduit 202 and the rod side and cap side fluid connections 172, 174, respectively. It will be appreciated that the check valves 220, 222 will unseat to permit flow if the pressure within the make-up conduit 202 is sufficiently greater than the pressures in rod side and cap side fluid connections 172, 174, respectively. The check valves 220, 222 may include any device for limiting flow in a piping system to a single direction known by one skilled in the art now and in the future.

Similarly, as a safety check, cross-over relief valves 224, 226 may be provided to permit flow between the rod and cap side fluid connections 172, 174, respectively, and the conduit 202, allowing fluid to be returned to the tank 190 in the event a pressure developed in the rod or cap side fluid connections 172, 174 exceeds a set valve. More specifically, relief valve 224 will operate when the pilot connection 228 indicates that the pressure in the rod side fluid connection 172 exceeds a set value. Similarly, relief valve 226 will operate when the pilot connection 230 indicates that the pressure in the cap side fluid connection 174 exceeds a set value. These relief valves 224, 226 would typically be set to operate at relatively large pressure levels in order to prevent damage to the system, as, for example, when piston 164 reaches the end of stroke while the flow from the pump 180 is nonzero, or when there is a failure in other components of the hydraulic system 104. The relief valves 224, 226 may include any selectively operational device for providing flow in a piping system known by one skilled in the art now and in the future.

Under certain conditions, unintended motion can happen when there is a change in load even though there is no operator command. In order to substantially prevent a drop of the load, load holding valves 340, 342 are provided in the rod and cap side fluid connections 172, 174, respectively, to substantially prevent flow to and from the rod chamber 168 and the cap side chamber 170, for example, when movement of the pump 180, 258 is not commanded, the hydraulic system 100, 250 is turned off, or hydraulic operation of the actuator 132, 260 is locked out. The load holding valves 340, 342 include default positions 344, 346 that substantially prevent flow through the valves 340, 342, and active positions 348, 350 that allow flow through the rod side fluid connection 172 or the cap side fluid connection 174, that is, to and from the rod and cap side chambers 168, 170, respectively. The load holding valves 340, 342 are disposed in the default positions 344, 346 when movement of the pump 180, 258 is not commanded, the hydraulic system 100, 250 is turned off, or hydraulic operation of the actuator 132, 260 is locked out. In this way, the load holding valves 340, 342 substantially prevent undesirable movement of the actuator 132, as may result from system leakage or the like when the displacement of the variable displacement pump 180, 258 is zero or when the engine is off. Conversely, the load holding valves 340, 342 are disposed in the active positions 348, 350 when a position of the actuator 132 is commanded, and the variable displacement pump 180 is actuated, allowing for execution of actuator commands.

Actuation of the load holding valves 340, 342 may be provided by any appropriate arrangement. In the embodiment shown in FIGS. 2-6, hydro-mechanical actuation of the load holding valves 340, 342 is provided. To this end, a plurality of pilots 352, 354, 356, 358, 360, 362 from the rod and cap side fluid connections 172, 174 to either end of the load holding valves 340, 342. While the detail of the operation of the load holding valves 340, 342 will not be explained herein in detail, suffice it to say that when fluid pressure is applied to first actuating end or surface(s) of the load holding valves 340, 342 and second actuating end or surface(s) 368, 370 are open to the tank 190 by way of drain conduits 372, 374, the load holding valves 340, 342 will move from their no-flow positions 344, 346 to their flow positions 348, 350 to allow passage of hydraulic fluid through the rod side and cap side fluid connections 172, 174, respectively. When the second actuating ends or surfaces 368, 370 are not open to the tank 190, pressure builds at the second actuating ends or surfaces 368, 370 to move the load holding valves 340, 342 to, or maintain the load holding valves 340, 342 in their no-flow positions 344, 346.

Turning now to the control of the pump 180, in the embodiment illustrated in FIGS. 2-6, an electro-hydraulic control circuit 290 including mechanical position feedback is provided in order to control the position of the swash plate 181 of the pump 180. It will be appreciated, however, that the pump 180 may be controlled by any appropriate arrangement. The control circuit 290 illustrated is provided by way of example only. The control circuit 290 includes at least one control valve 292 and a plurality of connecting conduits controlling flow to and from a swash plate control assembly 316, and a load holding control valve 384, the significance of which will be discussed below. In the illustrated embodiment, the control valve 292 is a solenoid actuated multi-position valve, as shown in FIGS. 2-6, and in the enlarged view of FIG. 7. The control valve 292 includes four ports identified as 294, 296, 298, 300, 398, 399 and has three positions, identified as 302, 304, 306.

Port 294 is fluidly connectable to conduit 295, which is fluidly coupled to charge conduit 188 of the charge circuit 182. Port 296 is fluidly connectable to conduit 297, which is fluidly coupled to return conduit 201 of the charge circuit 182. Port 298 is fluidly connectable to conduit 299, while port 300 is fluidly connectable to conduit 301, conduits 299 and 301 providing flow to the swash plate control assembly 316. Port 398 is fluidly connectable to pilot line 244, while port 399 is fluidly connectable to pilot line 382, pilot lines 244, 382 providing pressure load holding valve 384.

When the system 104 is in neutral, the control valve 292 is in the central, default position 302. as a result, port 294 is maintained substantially at charge pressure, while the remaining ports 296, 298, 300, 398, 399 are at close to tank 190 pressure.

The second and third, activated positions 304, 306 provide cross flow between different sets of ports 294, 296, 298, 300, 398, 399. The second, activated position 304 provides for flow from port 294 to ports 300, 399, and flow from ports 298, 398 to port 296, that is, from conduit 295 to conduit 301 and pilot line 382, and from conduit 299 and pilot line 244 to conduit 297. The third, activated position 306 provides for flow from port 294 to ports 298, 398, and flow from ports 300, 399 to port 296, that is, from conduit 295 to conduit 299 and pilot line 244, and from conduit 301 and pilot line 382 to conduit 297.

Flow from conduits 299, 301 to ports 312, 314 at either end of the swash plate control assembly 316 control the motion and shift of an element 318 within the swash plate control assembly 316. Those of skill in the art will appreciate that the location of the piston 318 controls the position of the swash plate 181, and, therefore, the displacement of the pump 180, and the associated flow rate. When in neutral, the swash plate control assembly 316 is centered by biasing force such as springs, such that the pump 180 will provide for zero displacement.

When the control valve 292 is in the second, activated position identified as 304, however, flow is directed from conduit 295 from the charge circuit 182, through ports 294 and 300 to conduit 301 and port 314 of the swash plate control assembly 316, while flow from the opposite side of the swash plate control assembly 316 is directed through port 312, conduit 299, port 298, port 296 to conduits 297 and 201 to return to the tank 190. This movement (upward as illustrated in FIGS. 2-7) results in positioning of the swash plate 181 to provide a positive displacement of the pump 180, the angle of the swash plate 181 determining the volume of fluid displaced.

When the control valve 292 is in the third, activated position identified as 306, flow is directed from conduit 295 from the charge circuit 182, through ports 294 and 298 to conduit 299, through port 312 of the swash plate control assembly 316, while flow from the opposite side of the piston assembly 318 is directed through port 314, conduit 301, port 300, port 296 to conduits 297 and 201 to return to the tank 190. This movement (downward as illustrated in FIGS. 2-7) yields positioning of the swash plate 181 to provide a negative displacement of the pump 180, the angle of the swash plate 181 determining the volume of fluid displaced.

In use, the operator utilizes the operator control 115 to provide a signal that identifies the desired movement to a controller 320 (see FIG. 2). In the embodiment illustrated in FIGS. 1-7, this signal identifies the desired movement of the actuator 132. Based upon one or more signals, including the signal from the operator control 115, and, for example, the current position of the actuator 132, the controller 320 provides a signal to the solenoid 322, 324 at either end of the control valve 292 to advance the control valve 292 to the desired position 302, 304, 306. The current position of the actuator 132 may be determined, for example, by way of one or more sensors 326 provided, by way of further example, on the rod 166 and/or cylinder 162 of the actuator 132. Alternately, the position of the piston 164 within the actuator 132 may be estimated by techniques known to those of skill in the art. It will be appreciated, however, that any appropriate method of determining the position of the actuator 132 now known or identified in the future may be utilized.

It is noted that when the control valve 292 is moved to either its second or third position 304, 306, fluid pressure is established to either pilot line 244 or pilot line 382 to move the load holding control valve 384 from its no-flow, first position 386 to one of its flow, second or third position 388, 390 to open the load holding valves 340, 342 to the tank 190 by way of drain conduits 372, 374 and conduit 392. When the pump 180 is no longer commanded, the hydraulic system 104 is turned off, or hydraulic operation of the actuator 132 is locked out, the control valve 292 moves to its first position 302, and the load holding control valve 384 moves to its no-flow, first position 386, discontinuing flow from the second actuating ends or surfaces 368, 370 of the load holding valves 340, 342 to the tank 190. As a result, pressure on the second actuating ends or surfaces builds to move the load holding valves 340, 342 to their no-flow positions 344, 346.

Turning now to the general operation of the hydraulic system 104 under different operating conditions, FIGS. 3-6 illustrate the positions of the components of the hydraulic system 104 during the movements identified as arcs 154, 156, 158, 160 in FIG. 2, respectively. In FIGS. 3-6, the active positions of the various valves of the hydraulic system 104 are shown as shaded. The general operation of the actuator 132, as well as the charge and make-up circuits 182, 184 will be explained in this section of the disclosure, while other aspects of the operation will be explained after further explanation of additional components.

Figure 3:
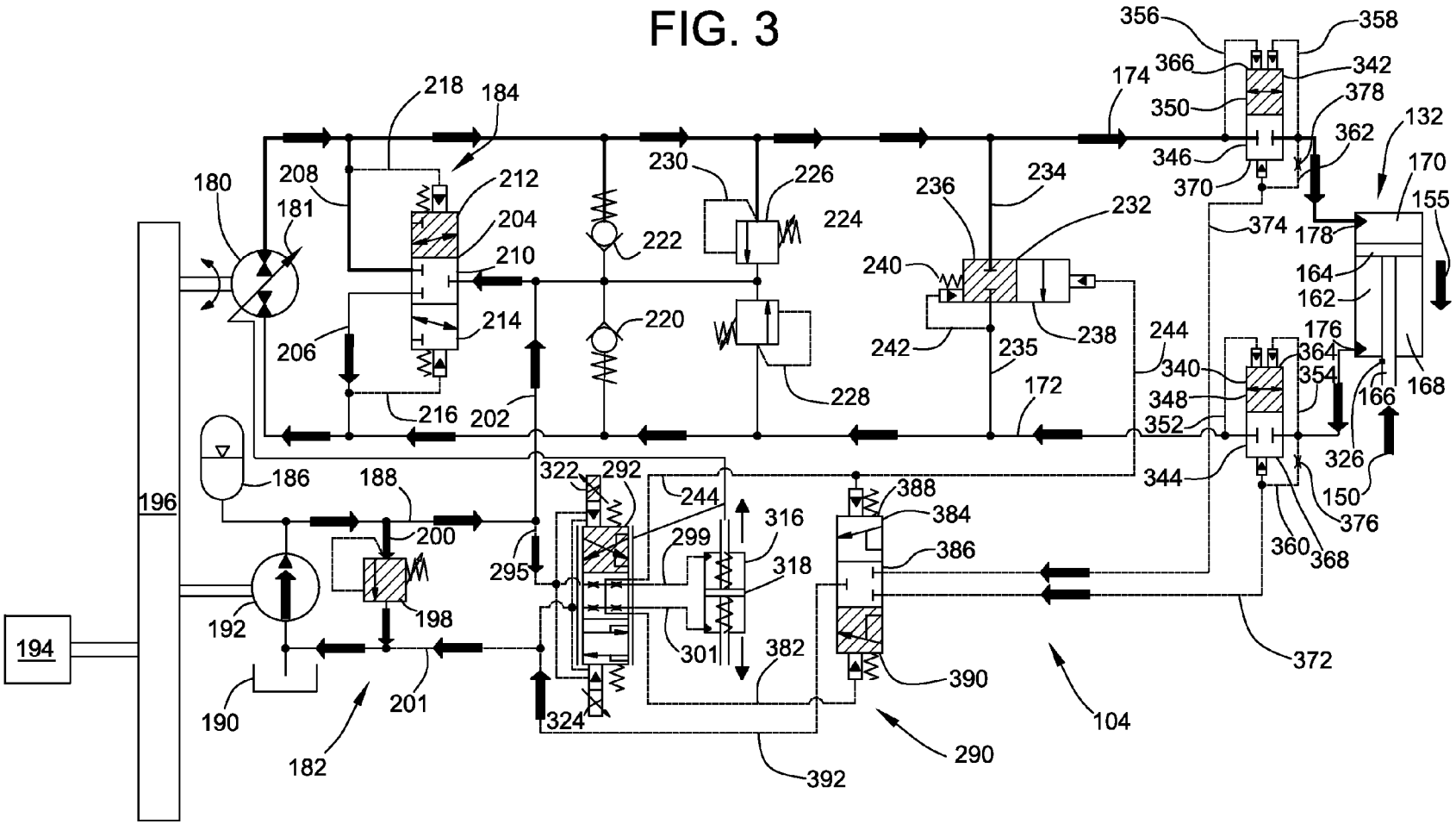
FIG. 3 is a fragmentary schematic view of the hydraulic system of FIG. 2 wherein an extension of a piston is commanded, and the pump operates as a pump.

FIG. 3 schematically illustrates the positions of the components of the hydraulic system 104 during a so-called "pumping extension" of the actuator 132, that is, along the arc identified as 154 in FIG. 1. The force of the load 150 is indicated by the arrow of the same number, while the direction of the commanded motion is indicated as arrow 155.

Figure 7:
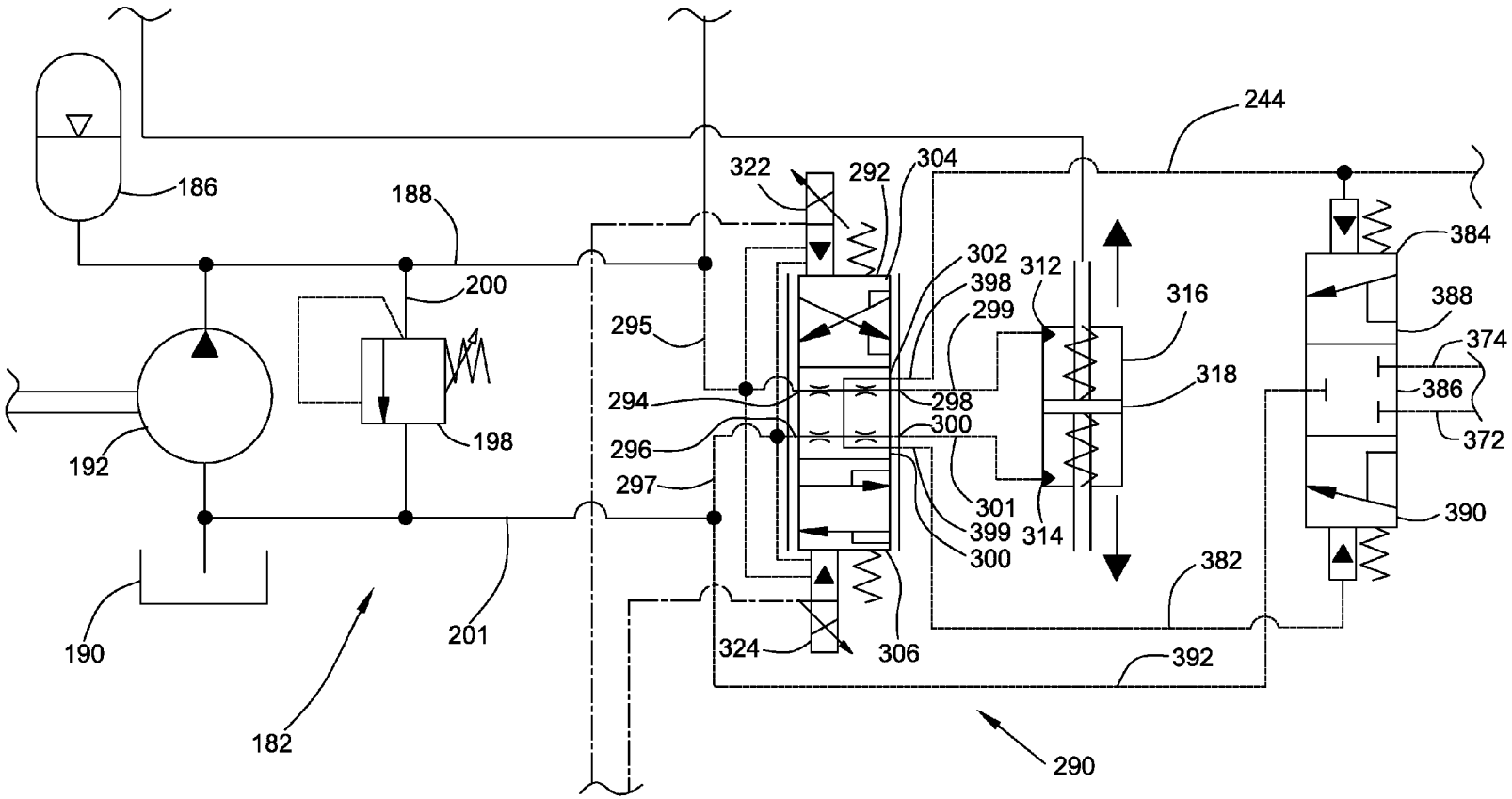
FIG. 7 is an enlarged fragmentary view of the pump displacement control of FIG. 2.

When the operator commands an extension of the actuator 132 to yield movement along arc 154, as shown in FIG. 1, the solenoid 322 is actuated to move the control valve 292 to the second position 304, as shown in FIGS. 3 and 7. As a result, at least a portion of the flow from the charge circuit 182 is directed to the swash plate control assembly 316 through port 314, resulting in movement of the swash plate 181 to provide a positive displacement of the pump 180.

In order to extend the actuator 132 in the direction of commanded motion 155, operating as a pump, the pump 180 pumps hydraulic fluid from the rod side fluid connection 172, that is, from the rod chamber 168 of the actuator 132, through the cap side fluid connection 174 to the cap side chamber 170 of the actuator 132.

As explained above, in this mode of operation, additional hydraulic fluid volume is required to supplement the fluid from the rod chamber 168 in order to fill the corresponding additional space in the cap side chamber 170. Illustrated by the heavier lines in FIG. 3, the hydraulic fluid in the cap side fluid connection 174 is at a higher pressure than the hydraulic fluid in the rod side fluid connection 172. This difference in fluid pressures within the rod and cap side fluid connections 172, 174 is likewise conveyed to the pilot connections 216, 218 on either side of the make-up valve 204. As a result, the make-up valve 204 is advanced to position 212, providing a connection between the rod side conduit 206 and conduit 202, which is fluidly coupled to the fluid source, i.e., the accumulator 186 and/or the pump 192 and tank 190. In this way, fluid from the fluid source is provided to the rod side connection 172 to supplement hydraulic fluid from the rod chamber 168. During normal operation, the hydraulic fluid within conduit 188 will be at a higher pressure than the hydraulic fluid within conduit 202, rod side conduit 206, and the rod side fluid connection 172. Consequently, additional suction may be established that assists in the flow of fluid from the fluid source to the pump 180 for delivery to the cap side chamber 170.

Figure 4:
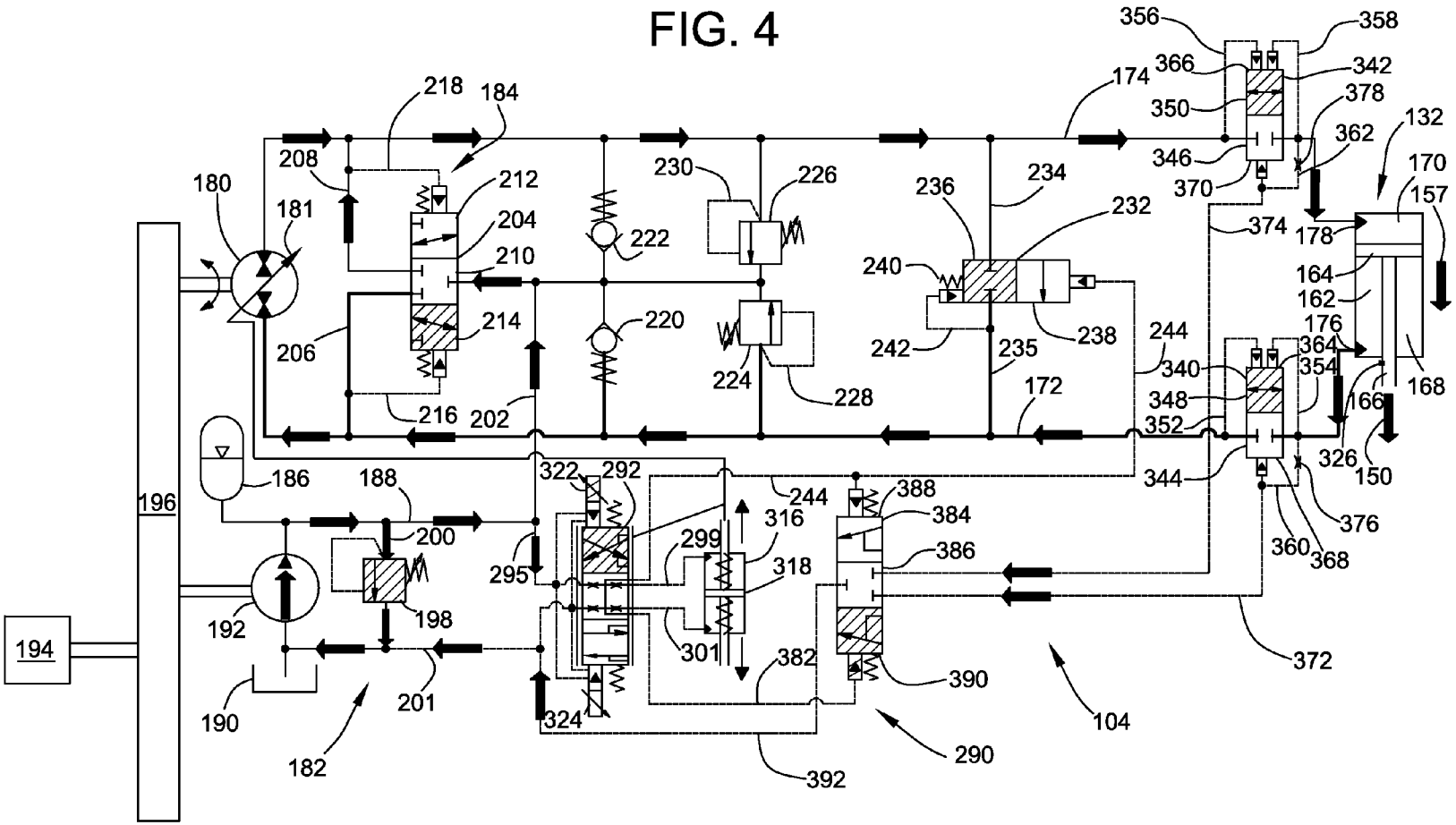
FIG. 4 is a fragmentary schematic view of the hydraulic system of FIG. 2 wherein an extension of a piston is commanded, and the pump operates as a motor.

FIG. 4 schematically illustrates the positions of the components of the hydraulic system 104 during a so-called "motoring extension" of the actuator 132, that is, along the arc identified as 156 in FIG. 1. The force of the load 150 is indicated by the arrow of the same number, while the direction of the commanded motion is indicated as arrow 157.

When the operator commands a retraction of the actuator 132 to yield movement along arc 156, as shown in FIG. 1, the solenoid 322 is actuated to move the control valve 292 to the second position 304, as shown in FIGS. 4 and 7. As a result, at least a portion of the flow from the charge circuit 182 is directed to the swash plate control assembly 316 through port 314, resulting in movement of the swash plate 181 to provide a positive displacement of the pump 180.

It should be noted that the force of the load 150 and the commanded motion 157 extend in the same direction. As a result, the load 150 assists in the extension of the actuator 132. This results in the establishing a high pressure in the rod side fluid connection 172 (see heavier lines) as compared with the pressure in the cap side fluid connection 174 as hydraulic fluid from the rod chamber 168 flows through the rod and cap side fluid connections 172, 174 to the cap side chamber 170 in order to extend the actuator 132 in the direction of commanded motion 157. As a result of this flow, the pump 180 acts as a motor, rather than a pump, as fluid flows from the higher pressure rod side fluid connection 172 to the lower pressure cap side fluid connection 174.

As explained above, in this mode of operation, additional hydraulic fluid volume is required to supplement the fluid from the rod chamber 168 in order to fill the corresponding additional space in the cap side chamber 170. Referring to the operation of the make-up valve 204, the difference in pressures between the rod and cap side fluid connections 172, 174 is likewise conveyed to the pilot connections 216, 218 on either side of the make-up valve 204. As a result, the make-up valve 204 is advanced to its third position 214, providing a connection between the cap side conduit 208 and conduit 202, which is fluidly coupled to the fluid source, i.e., the accumulator 186 and/or the pump 192 and tank 190. In this way, as the fluid from the fluid source is provided to the cap side connection 174 to supplement hydraulic fluid from the rod chamber 168 as a suction is established to assist in the flow of fluid from the fluid source to the cap side fluid connection 174 for delivery to the cap side chamber 170.

Figure 5:
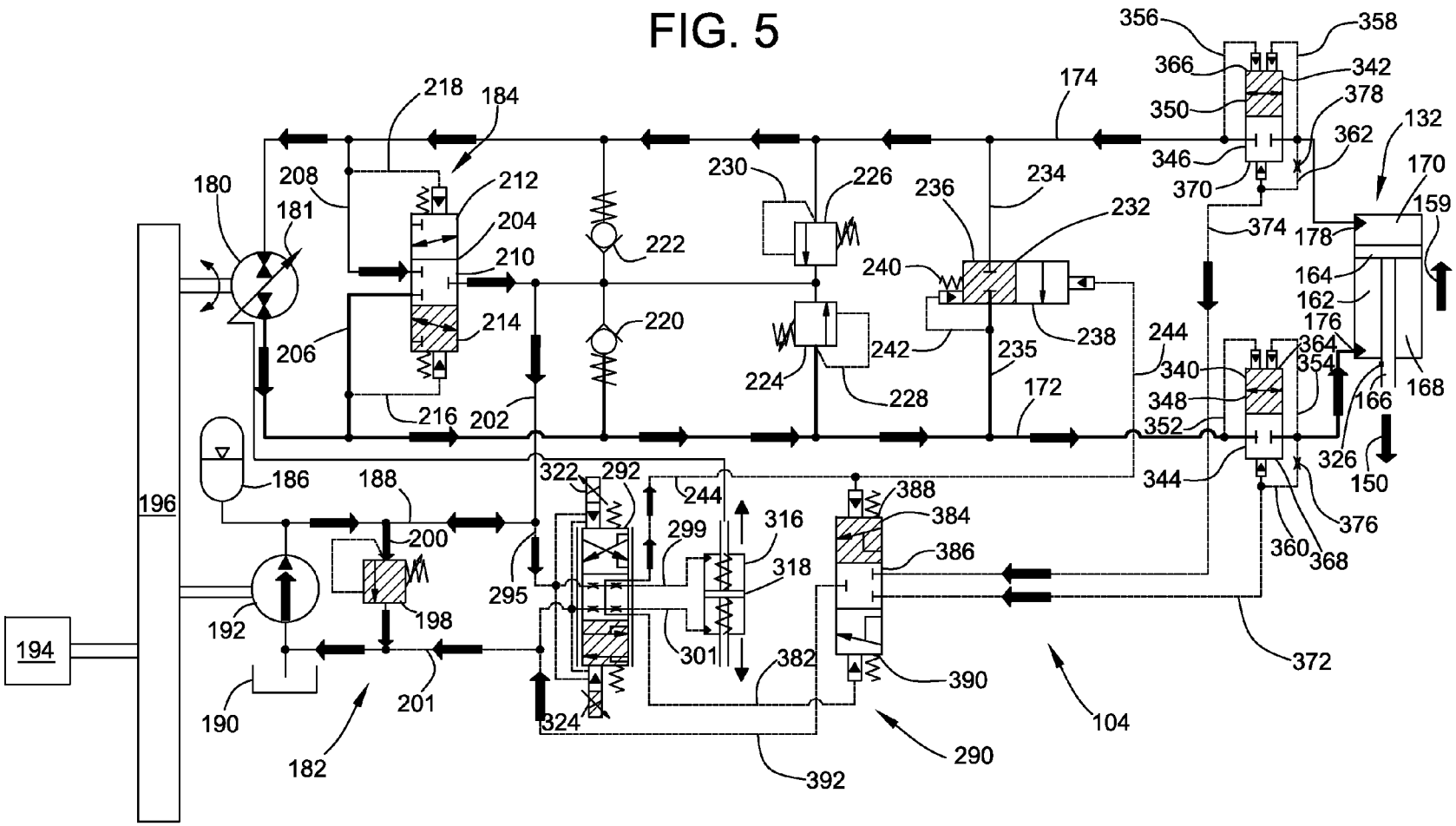
FIG. 5 is a fragmentary schematic view of the hydraulic system of FIG. 2 wherein a retraction of a piston is commanded, and the pump operates as a pump.

FIG. 5 schematically illustrates the positions of the components of the hydraulic system 104 during a so-called "pumping retraction" of the actuator 132, that is, along the arc identified as 158 in FIG. 1. The force of the load 150 is indicated by the arrow of the same number, while the direction of the commanded motion is indicated as arrow 159, i.e., the commanded motion 159 must work against the force of the load 150.

When the operator commands a retraction of the actuator 132 to yield movement along arc 158, as shown in FIG. 1, the solenoid 324 is actuated to move the control valve 292 to the third position 306, as shown in FIGS. 5 and 7. As a result, at least a portion of the flow from the charge circuit 182 is directed to the swash plate control assembly 316 through port 312, resulting in movement of the swash plate 181 to provide a negative displacement of the pump 180.

In order to retract the actuator 132 in the direction of commanded motion 159, the pump 180 pumps hydraulic fluid from the lower pressure cap side fluid connection 174 and cap side chamber 170 to the higher pressure rod side fluid connection 172 (see heavier lines) to the rod chamber 168 of the actuator 132. Consequently, the pump 180 operates as a pump.

As a result of the difference in the pressures between the rod and cap side fluid connections 172, 174, the make-up valve 204 shifts to its third position 214. As explained above, in this mode of operation, not all of the hydraulic fluid volume displaced from the cap side chamber 170 can be utilized in the flow of hydraulic fluid to the rod chamber 168. When the make-up valve 204 is advanced to its third position 214, hydraulic fluid flow from the cap side chamber 170 of the actuator 132 that is not required to fill the rod chamber 168 is diverted from the cap side fluid connection 174 through the cap side conduit 208 to conduit 202 and on to the fluid source. In the illustrated arrangement, flow from conduit 202 proceeds through conduit 188 and the charge pilot valve 198 to the tank 190. It will be appreciated, however, that the flow from conduit 202 may proceed to the accumulator 186, or to the pump displacement control, as will be explained in greater detail below.

Figure 6:
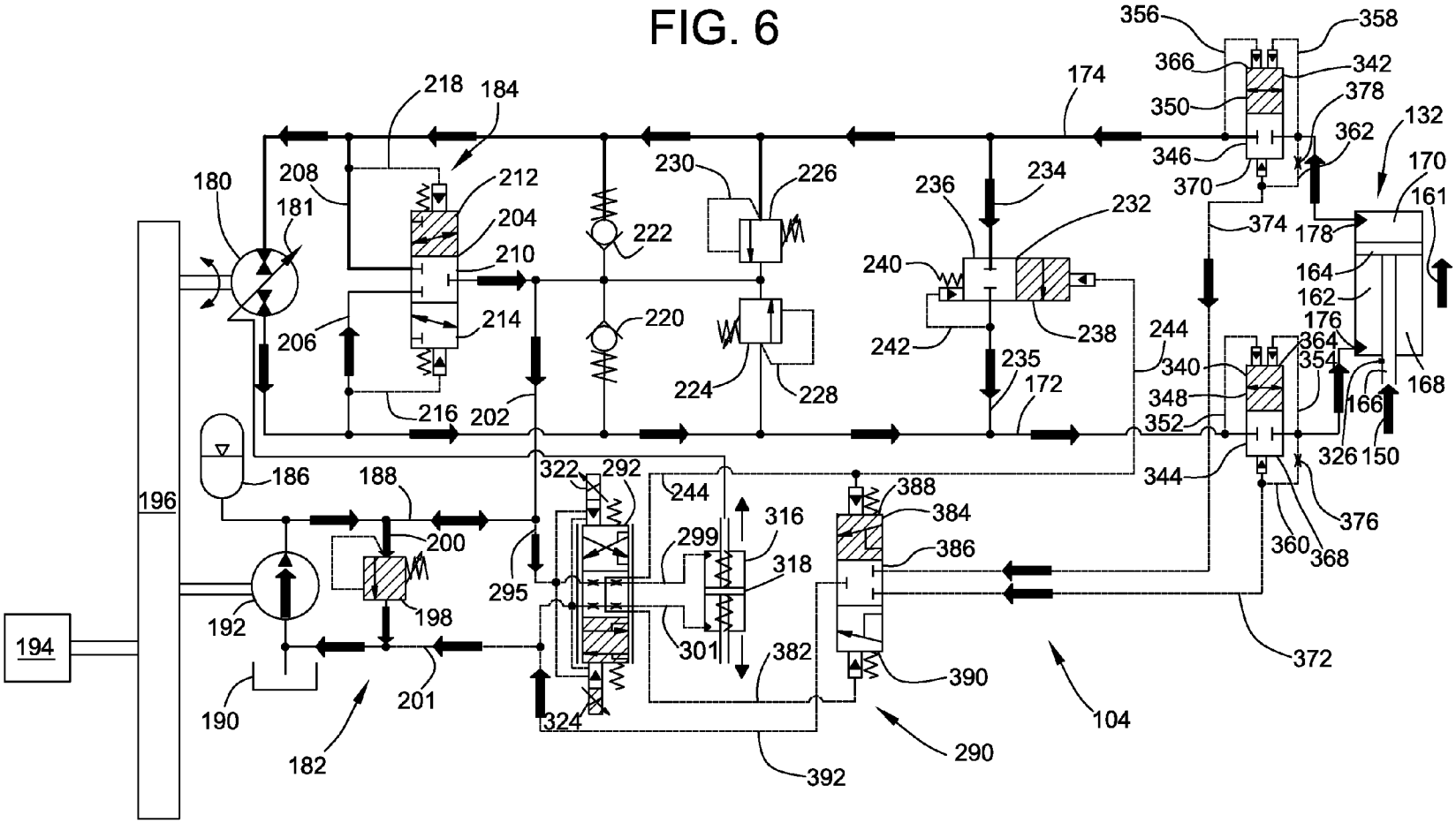
FIG. 6 is a fragmentary schematic view of the hydraulic system of FIG. 2 wherein a retraction of a piston is commanded, and the pump operates as a motor.

Finally, FIG. 6 schematically illustrates the positions of the components of the hydraulic system 104 during a so-called "motoring retraction" of the actuator 132, that is, along the arc identified as 160 in FIG. 1. The force of the load 150 is indicated by the arrow of the same number, while the direction of the commanded motion is indicated as arrow 161.

When the operator commands a retraction of the actuator 132 to yield movement along arc 160, as shown in FIG. 1, the solenoid 324 is actuated to move the control valve 292 to the third position 306, as shown in FIG. 6. As a result, at least a portion of the flow from the charge circuit 182 is directed to the swash plate control assembly 316 through port 312, resulting in movement of the swash plate 181 to provide a negative displacement of the pump 180.

It should be noted that the force of the load 150 and the commanded motion 161 extend in the same direction. As a result, the load 150 assists in the retraction of the actuator 132, and causes the pump 180 to operate as a motor. In this mode of operation, high pressure (see heavier lines) is established in the cap side fluid connection 174 as opposed to the rod side fluid connection 172 as fluid is forced from the cap side chamber 170 as a result of the force of the load 150 in conjunction with the commanded motion. The respective fluid pressures acting on the make-up valve 204 through pilot connections 218, 216, respectively, cause the make-up valve 204 to advance to its second position 212. In the second position 212, the make-up valve 204 connects the rod side conduit 206 with the conduit 202, further connecting a portion of the flow within the rod side fluid connection 172 with the tank 190 by way of the conduits 188, 200 and the charge pilot valve 198. In this way, the supplemental hydraulic fluid from the cap side chamber 170 that is not required to fill the rod chamber 168 is diverted to conduits 202, 188, 200 and on to the charge pilot valve 198 and the tank 190.

Significantly, however, all of the hydraulic fluid from the cap side chamber 170 would be advanced through the pump 180, increasing pump speed dramatically if no alternate provision is made for this flow. Such an arrangement can result in an overspeeding condition in the pump that can result in damage to the pump 180 or significant reduction in pump life. Those of skill in the art commonly refer to operation in this motoring retraction arrangement as an overrunning load pump condition.

In order to prevent or minimize overspeeding during a motoring retraction, such as is illustrated in FIG. 6, the hydraulic system 104 is provided with at least one regeneration valve 232 disposed in a regeneration conduit 234/235 between the piston and rod side fluid connections 174, 172. The regeneration valve 232 is selectively operable between a default position 236 and an actuated position 238 that allows flow from the cap side fluid connection 174 directly to the rod side fluid connection 172 through the regeneration conduit 234/235, rather than all fluid being directed through the pump 180. During all modes of operation other than a motoring retraction, such as is illustrated in FIG. 6, the regeneration valve 232 does not permit flow directly through the regeneration conduit 234/235 from the cap side fluid conduit 174 to the rod side fluid conduit 172; the regeneration valve 232 is actuated to allow flow from the cap side fluid conduit 174 through the regeneration conduit 234/235 to the rod side fluid connection 172 only during a motoring retraction, as shown in FIG. 6.

In the embodiment of FIGS. 2-7, a single regeneration valve 232 is provided, and the default position 236 of the regeneration valve 232 prevents flow through the regeneration conduit 234/235. Those of skill will appreciate that when in the default position 236, there may be some leakage past the regeneration valve 232, but great majority of flow through the regeneration valve 232 is prevented. When the regeneration valve 232 is actuated (see position 238), a portion of the flow from the cap side chamber 170 through the cap side fluid connection 174 is directed through the regeneration conduit 234/235, while the remainder of the flow continues through the cap side fluid connection 174 to the pump 180, minimizing the opportunity for overspeeding of the pump 180.

Thus, a portion of the flow from the pump 180 may join the flow from the regeneration valve 232 within the rod side fluid connection 172 to fill the expanding volume of the rod chamber 168. In the illustrated embodiment, the remainder of the unneeded fluid flow from the pump 180 is directed to the tank 190 through the rod side conduit 206 the make-up valve 204 disposed in position 212, the conduits 202, 188, 200, and through the charge pilot valve 198 to the tank 190. It is the diversion of a portion of the flow from the cap side fluid connection 174 directly to rod side fluid connection 172 through the regeneration valve 232, however, that substantially prevents or minimizes the opportunity for overspeeding of the pump 180.

The regeneration valve 232 may be operated by any appropriate arrangement. For example, the regeneration valve 232 may be operated hydraulically, as illustrated in FIGS. 2-7. In this embodiment, the regeneration valve 232 is biased to the no-flow, default position 236 by a spring 240 and pilot line 242 from the side of the regeneration conduit 235 in fluid communication with the rod side fluid connection 172.

In order to move the regeneration valve 232 to the actuated position 238, adequate force must be provided by a pilot line 244. The pilot line 244 in this embodiment is fluidly connected to the pump control circuit 290 such that no fluid pressure is provided to pilot line 244 when the control valve 292 is in its first position 302. Although some fluid pressure may be provided to pilot line 244 when the control valve 292 is in its second position 304, as shown in FIGS. 3 and 4, substantially all of the fluid from the swash plate control assembly 316 proceeds through conduit 299 to control valve 292 and on to the tank 190 through conduit 201. When the control valve 292 is in its third position 306, as shown, for example, in FIGS. 5 and 6, fluid pressure is provided through the control valve 292 through conduit 299 to pilot line 244.

Under the operating conditions shown in FIG. 5, however, a relatively high pressure is developed in rod side fluid connection 172, and, therefore, regeneration conduit 235 as illustrated by the heavier line in FIG. 5. As a result, the pressure in pilot line 242 and spring 240 provide a greater force that the force of the fluid pressure developed in pilot line 244 from the flow from control valve 292, causing the control valve 292 to remain in the no-flow position 236.

Under a motoring retraction, as shown in FIG. 6, for example, high pressure is on the cap side fluid connection 174, as opposed to the rod side fluid connection 172. Thus, low pressure is provided to the pilot line 242 from the rod side fluid connection 172, and the force from the fluid pressure within pilot line 244 is adequate to cause the regeneration valve 232 to shift to its activated position 238, providing flow from the cap side fluid connection 174 through the regeneration conduit 234/235 and the regeneration valve 232 to the rod side fluid connection 172.

The regeneration valve 232 may be of any appropriate design known to one skilled in the art now or in the future. It will be appreciated that the regeneration valve 232 may be designed such that the areas of the regeneration valve 232 upon which the applicable force act will provide actuation at the desired force differentials.

Figure 9:
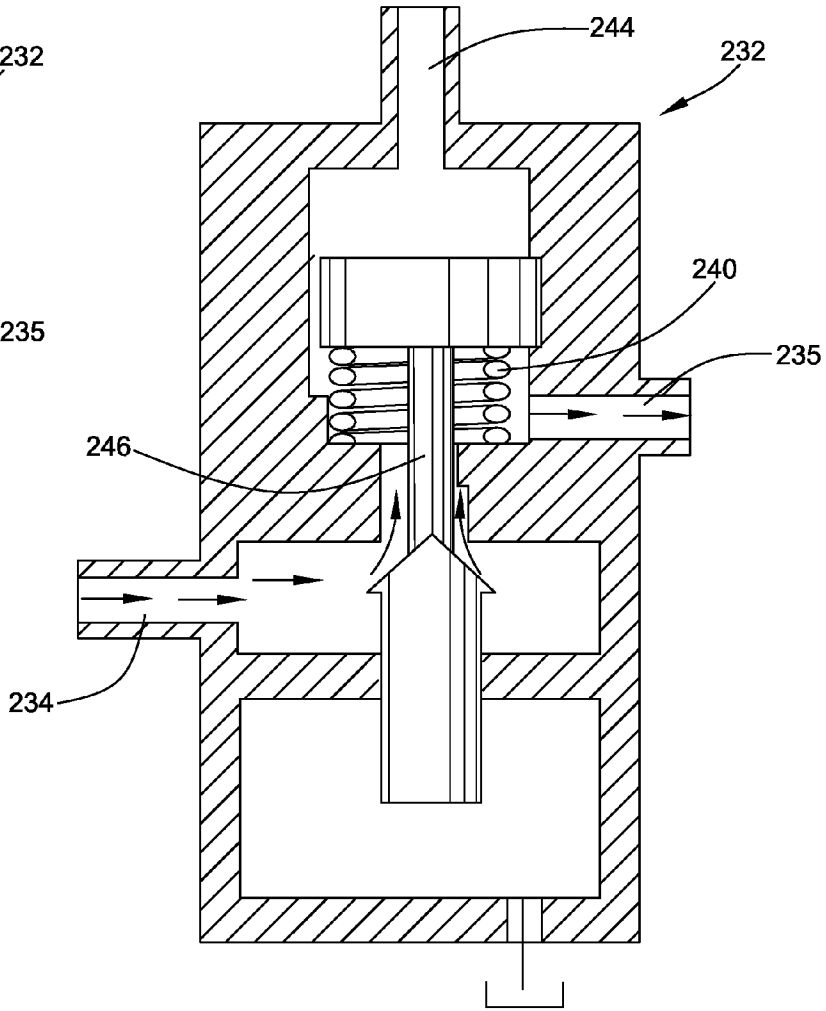
FIG. 9 is a side elevational view of the exemplary poppet type regeneration valve of FIG. 8 in a flow position.
Figure 8:
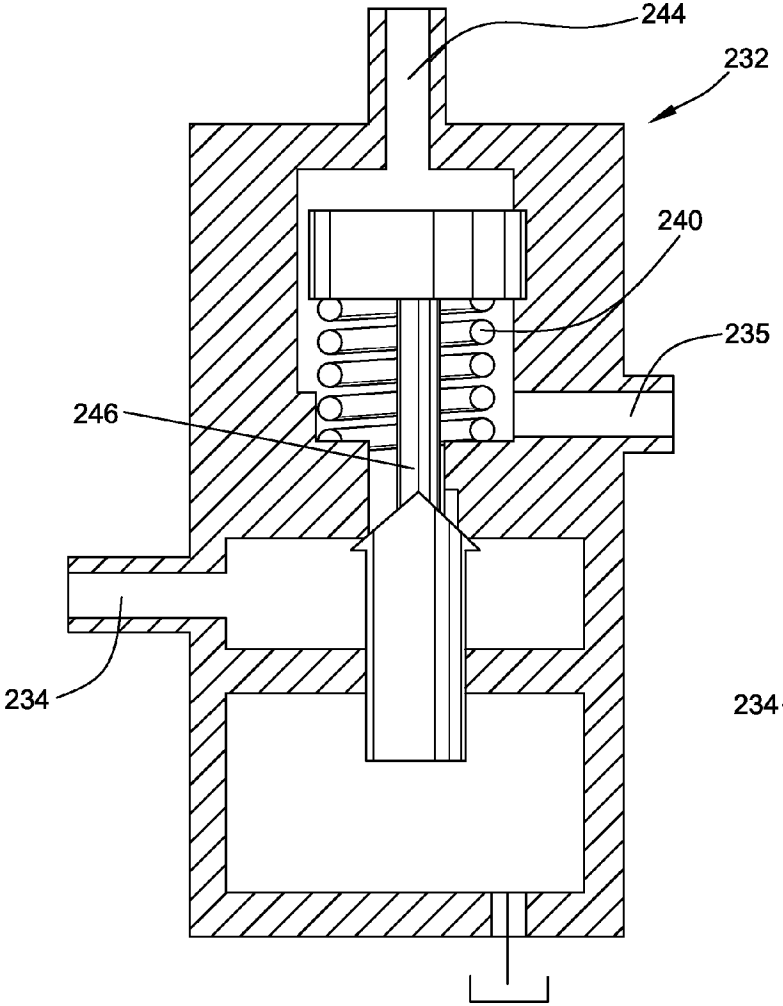
FIG. 8 is a side elevational view of an exemplary poppet type regeneration valve in a no-flow position.
Figure 11:
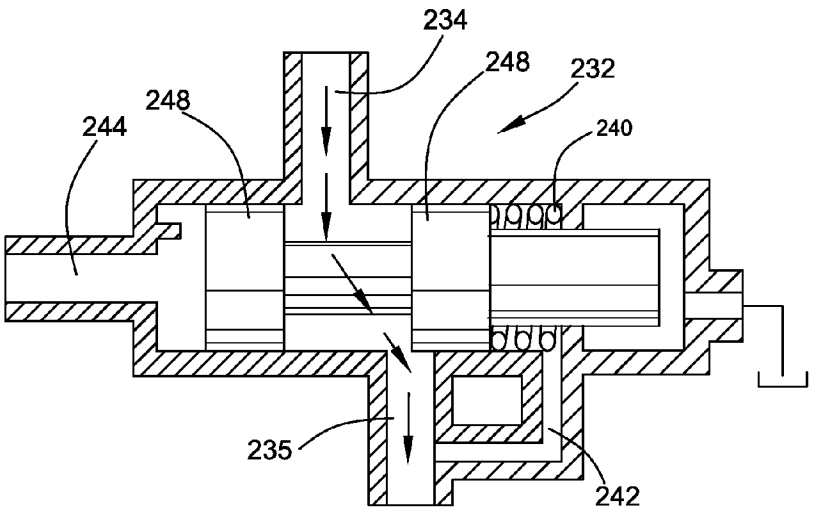
FIG. 11 is a side elevational view of the exemplary spool type regeneration valve of FIG. 10 in a flow position.

One example of an appropriate regeneration valve 232 is a poppet type valve, such as is illustrated in FIG. 8. In this embodiment, a piston assembly 246 is biased into the no-flow position 236 by the spring 240 and the force applied to the piston assembly 246 from regeneration conduit 235, the force applied at pilot line 244 is inadequate to overcome the force of the spring 240 and the force from the regeneration conduit 235. When the system is in a motoring retraction as in FIG. 6, however, the force applied at pilot line 244 overcomes the force of the spring 240 and regeneration conduit 235, to hydraulically cause a shift in the piston assembly 246 to the position shown in FIG. 9. In this way, flow is established from regeneration conduit 234 through the regeneration valve 232 to regeneration conduit 235.

Figure 10:
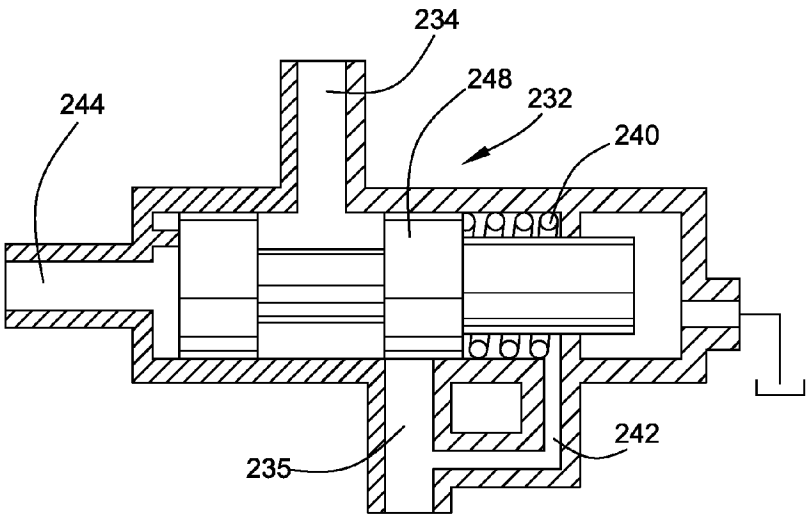
FIG. 10 is a side elevational view of an exemplary spool type regeneration valve in a no-flow position.

Another example of an appropriate regeneration valve 232 is a spool type valve, such as is illustrated in FIG. 10. In this embodiment, a piston assembly 248 is biased into the no-flow position 236 by the spring 240 and the force applied to the piston assembly 248 from regeneration conduit 235 via pilot line 242, the force applied at pilot line 244 is inadequate to overcome the force of the spring 240 and the force from pilot line 242 from the regeneration conduit 235. When the system is in a motoring retraction as in FIG. 6, however, the force applied at pilot line 244 overcomes the force of the spring 240 and the force from regeneration conduit 235 applied through pilot line 242, to hydraulically cause a shift in the piston assembly 248 to the position shown in FIG. 9. In this way, flow is established from regeneration conduit 234 through the regeneration valve 232 to regeneration conduit 235.

Figure 12:
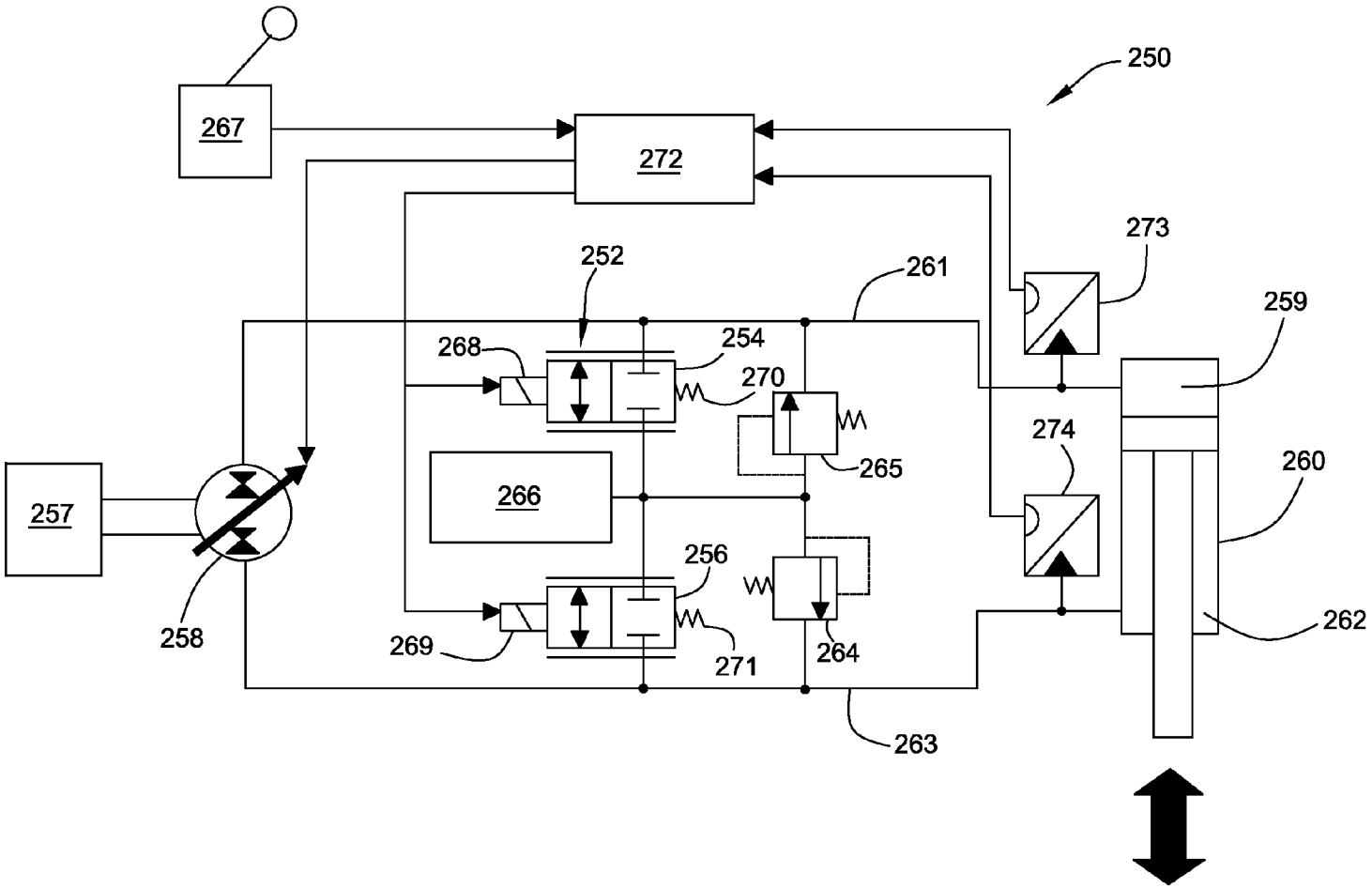
FIG. 12 is a schematic view of an alternate embodiment of a hydraulic system according to this disclosure.

Turning now to the embodiment illustrated in FIG. 12, there is illustrated a hydraulic system 250 wherein a regeneration circuit 252 includes a pair of valves 254, 256. In this embodiment, the hydraulic system 250 similarly includes a prime mover 257 that drives a variable displacement pump 258 that is fluidly coupled to a cap side chamber 259 of an actuator 260 by a cap side end fluid connection 261 and a rod chamber 262 of the actuator 260 by a rod end fluid connection 263; cross-over relief valves 264, 265 are disposed and selectively actuatable to fluidly couple the cap side end fluid connection 261 and the rod end fluid connection 263. A charge circuit 266 provides or receives excess hydraulic fluid during execution of control commands from an operator control 267 by way of valves 254, 256. In this way, the valves 254, 256 act as both make-up valves and regeneration valves. More specifically, during a motoring retraction of the actuator 260, both valves 254, 256 are opened in order to provide a direct connection between the cap side end fluid connection 261 and the rod end fluid connection 263, such that a portion of the fluid flow bypasses the pump 258 to minimize or eliminate the opportunity for overspeeding.

In the embodiment of FIG. 12, the valves 254, 256 are electronically controlled by solenoids 268, 269, as opposed to the mechanically controlled regeneration valve 232 of the embodiment of FIGS. 2-7. When the solenoids 268, 269 are actuated, the respective valves 254, 256 move from their no-flow positions to allow flow across the valves 254, 256. When the solenoids 268, 269 are deactuated, springs 270, 271 return the valves 254, 256 to their original no-flow positions.

In operation, the operator utilizes the operator control 267 to issue a command for a given actuator 260 velocity and direction, which provides a pump displacement command to a controller 272. Pressure transducers 273, 274 or similar sensors may be disposed to additionally provide pressures at the work ports of the actuator 260 to the controller 272. Additional sensors may be disposed to provide information to the controller 272. For example, a position sensor or the like may be provided to identify the position of the actuator 260.

Based upon the command and optionally other inputs, the controller 272 issues a command to the pump 258, and, as appropriate, commands to either or both of the valves 254, 256. For example, in a pumping extension, valve 256 may be opened in order to provide additional fluid from the charge system to the rod side fluid connection 263. Conversely, during a motoring extension, valve 254 may be opened in order to provide additional fluid directly to the cap side fluid connection 261 from the charge circuit 266. During a pumping retraction, valve 254 may be opened in order to provide a path for excess flow from the cap side chamber 259 through the cap side fluid connection 261 to the charge circuit 266. Finally, as indicated above, during a motoring retraction, both valves 254, 256 are opened to provide a direct fluid connection from the cap side fluid connection 261 to the rod side fluid connection 263 in order to minimize opportunity for overspeeding; in this configuration, connection is likewise provided to the charge circuit 266 in the illustrated embodiment. Additionally, based upon the command as well as the workport pressures provided by the pressure transducers 273, 274, the controller 272 may issue commands to the valves 254, 256 to control the pressure and maintain a desired speed of the actuator 260.

Figure 13:
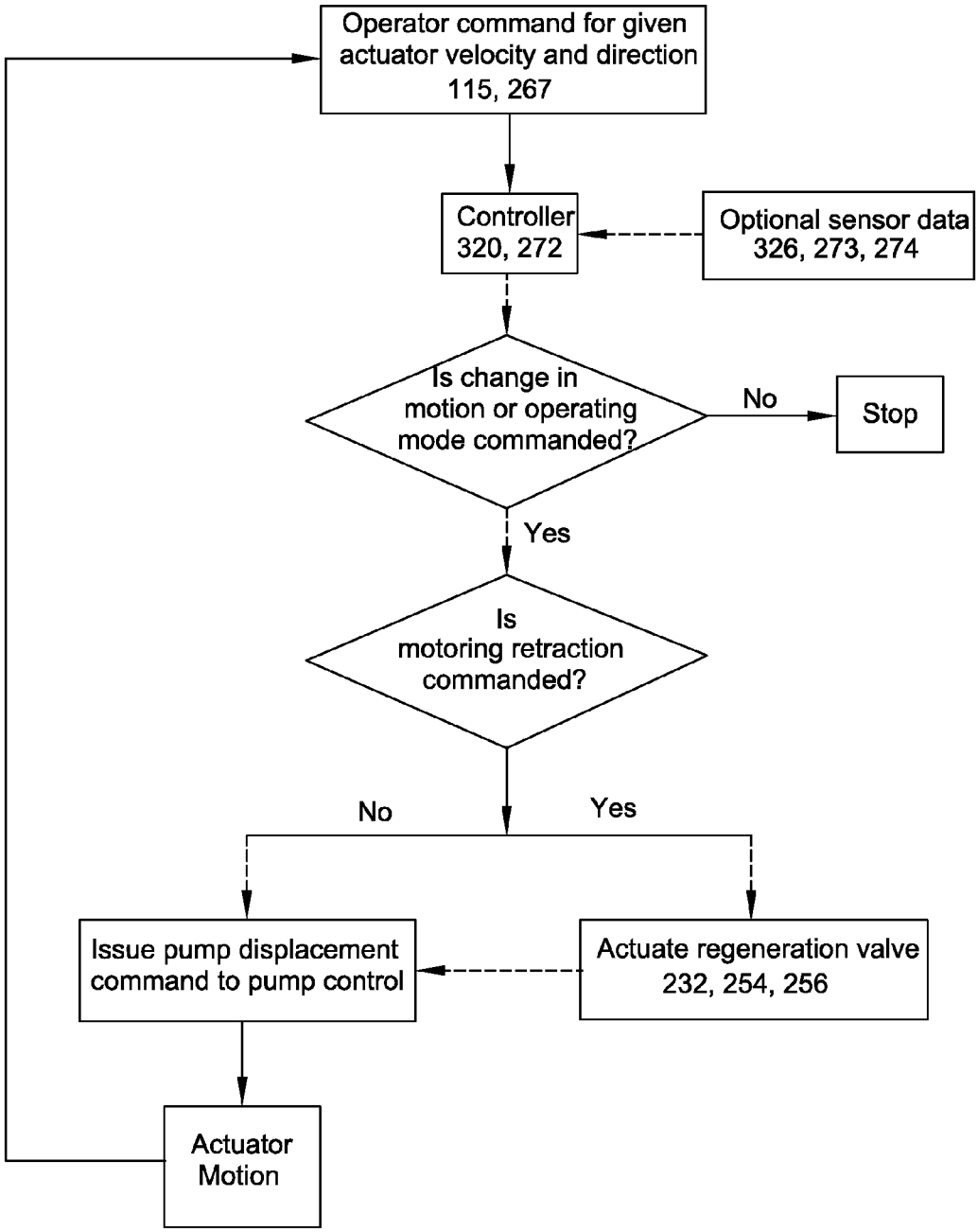
FIG. 13 is a flow diagram of a method according to the disclosure.

In the embodiments of both FIGS. 2-7 and FIG. 12 and the method of FIG. 13, the controller 320, 272 may be one or more controllers, and may include a processor (not shown) and a memory component (not shown). The processor may be microprocessors or other processors as known in the art. In some embodiments the processor may be made up of multiple processors. The processor may execute instructions for generating a required fluid flow to provide the actuator 132, 260 velocity, and, accordingly, desired displacement of the pump 180, 258, such as the methods described below in connection with FIG. 13 below, for example. Such instructions may be read into or incorporated into a computer readable medium, such as the memory component or provided external to processor. In alternative embodiments, hard-wired circuitry may be used in place of or in combination with software instructions to implement tool a desired fluid flow from the pump. Thus embodiments are not limited to any specific combination of hardware circuitry and software.

It is additionally noted that several hierarchical controllers might be utilized. For example, a high-level controller can generate set points for engine power management and operator command signal conditioning (mapping lever positions to percent commands for example). A medium-level controller can be used to detect the operating mode of the actuator 132, 260 and issue valve/pump commands. Low-level controllers can then carry on the commands from higher level controllers such as to achieve the desired pump displacement.

The term "computer-readable medium" as used herein refers to any medium or combination of media that participates in providing instructions to processor for execution. Such a medium may take many forms, including but not limited to, non-volatile media, volatile media, and transmission media. Non-volatile media includes, for example, optical or magnetic disks. Volatile media includes dynamic memory. Transmission media includes coaxial cables, copper wire and fiber optics.

Similarly, common forms of computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, or any other medium from which a computer or processor can read. The memory component may include any form of computer-readable media as described above. The memory component may include multiple memory components.

The controller 320, 272 may be enclosed in a single housing. In alternative embodiments, the controller 320, 272 may include a plurality of components operably connected and enclosed in a plurality of housings. The controller 272 may be an integral part of a control panel (not shown) and may be fixedly connected to a terminal box (not shown). In another embodiment, the controller 320, 272 may be fixedly attached to the prime mover 194, 257, a generator (not shown), the cab 108, the undercarriage 110, and/or a frame (not identified) in a location other than the terminal box. In still other embodiments the controller 320, 272 may be located in a plurality of operably connected locations including being fixedly attached to the frame, the prime mover 194, 257, the generator, the terminal box, the cab 108, the undercarriage 110, and/or remotely to the generator.

The controller 320, 272 may be configured to generate a desired pump displacement signal as a function of the operator control signal and the actuator 132, 260 position signal or other sensor data. In one embodiment, one or more commands from the controller 320, 272 may be signals that command one or both of the valves 292, 254, 256 to move to a desired position, as well as, for example, command actuation of one or more solenoids 322, 324 to move an associated control valve 292 to the desired position to adjust a swash plate 181 of the pump 180, 258. In other embodiments the desired pump displacement signal may be a digital signal, or any other signal that would control, actuate, or position the swash plate that would be known by an ordinary person skilled in the art now or in the future. In other embodiments, one or more commands from the controller may be signals that command a motor associated with a fixed displacement pump to provide the desired fluid flow from the pump (not shown).

The controller 320, 272 may be communicatively coupled to the solenoids 322, 324, 268, 269 or the valves 292, 254, 256 through at least one signal output port. The controller 320, 272 may be communicatively coupled to the position sensor (not shown) to receive the position signal. The controller 320, 272 may be communicatively coupled to the solenoid 268, 269. The controller 320, 272 may be communicatively coupled to the operator control 115, 267 to receive the signal corresponding to a commanded motion. The controller 320, 272 may be communicatively coupled to a display (not shown).

A method of operating a hydraulic system 104, 250 is illustrated in FIG. 13. An operator commands motion for a given velocity and direction of actuator 162, 260, generally, utilizing an operator control 115, 267. A signal is provided to a controller 320, 272, the structure of which is discussed in greater detail above. Additional information may likewise be provided to the controller 115, 267, such as, for example, sensor data from pressure transducers 273, 274, one or more position sensors 326, an end of stroke signal switch (not shown), or other sensors, transducers or switches (not shown). Sensor data may include, for example, information regarding pump displacement angle, pump shaft speed, cylinder cap side end pressure, cylinder rod end pressure, cylinder position, rod position relative to the cylinder, or cylinder end of stroke signal.

If no change in the motion of the actuator 162, 260 or operating mode of the system is commanded by the operator, no further action is taken by the controller 320, 272 to modify the displacement of the pump 180, 258 or to the regeneration valves 232, 254, 256. If, however, a change in the operating mode or the motion of the actuator 162, 260 is commanded, it is determined whether a motoring retraction has been commanded. The operating mode may be detected, for example, using both the pump displacement command from the operator control 115, 267, and from load pressure. The load pressure is the difference in pressure between the cap side chamber 170, 259 and rod chamber 168, 262. In the embodiment of FIG. 12, for example, the pressures of the cap side chamber 259 and rod chamber 262 are determined by pressure transducers 273, 274.

If a motoring retraction is not commanded, the controller 320, 272 issues a displacement command to the pump control to provide the desired actuator 132, 260 motion. In the embodiment of FIGS. 2-7, the pump 180 is commanded by the pump control circuit 290, although any appropriate arrangement may be utilized. In the embodiment of FIG. 12, the pump displacement control is not shown in detail.

If, however, a motoring retraction is commanded, then the controller 320, 272 issues a command causing the regeneration valve(s) 232, 254, 256 to be actuated to permit flow from the cap side fluid connection 174, 261 to the rod side fluid connection 172, 263. The command may be executed as a hydro-mechanical actuation of the valve(s) 232, as in FIGS. 2-7, or as an electrical/hydraulic actuation of the valve(s) 254, 256, as in FIG. 12. Moreover, the command may be executed directly, as with the solenoids 268, 269 actuating the valves 254, 256 in FIG. 12, or indirectly, as with the command actuating a control valve 292 that provides another result, such as the flow to the pilot line 244 to actuate the valve 232 in FIGS. 2-7. Additionally, the command may be executed before, concurrently with, or following a displacement command to the pump control. For example, in the embodiment of FIGS. 2-7, the displacement command and the command to actuate the regeneration valve 232 are issued simultaneously, actuation of the control valve 292 resulting in both the desired swash plate 181 angle for the commanded pump 180 displacement and the actuation of the regeneration valve 232.

Industrial Applicability

The present disclosure is applicable to machines that utilize meterless control systems to provide movement of hydraulic actuators having unequal areas on either side of the piston. More particularly, it is applicable to such systems wherein its pump may act as a motor during retraction of the actuator, as in, for example, hydraulic excavators, wheel loaders, and skid steer loaders. The disclosure may be applicable so such machines that are subject to resistive and overrunning loads.

In one or more embodiments, the arrangements and/or methods may prevent or minimize the opportunity for the pump to over speed when the actuator retracts under an overrunning load.

One or more embodiments may eliminate the need for metering valves controlling fluid flow for operation of an actuator. Inasmuch as metering valves may be inefficient, one or more of the disclosed arrangements and/or methods may be more efficient than traditional metering systems.

In one or more embodiments, the arrangements and/or methods may obviate arrangements with multiple pumps for controlling flow to/from an actuator.

In some embodiments, a high performance (fast response) pump 180, 258 may not be required.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A hydraulic system comprising:

an actuator having a piston disposed within a cylinder, and a rod extending from the piston and extending out of the cylinder, the piston defining a rod chamber and a cap side chamber within the cylinder, a pump adapted to operate as a pump or as a motor, the pump being adapted to selectively provide varied flow rates, the pump being adapted to selectively deliver pressurized hydraulic fluid to and receive pressurized hydraulic fluid from the chambers of the actuator, movement of the piston relative to the cylinder being dependent upon the selectively varied flow rates, a rod side fluid connection between the pump and the rod chamber, a cap side fluid connection between the pump and the cap side chamber, at least one selectively actuatable regeneration valve disposed to selectively provide flow from the cap side fluid connection to the rod side fluid connection, and a controller that controls the selectively varied flow rate of the pump in response to a commanded motion and relative positions of the piston and cylinder, the controller being configured to cause the actuation of the regeneration valve during a retraction of the piston into the cylinder when the pump is acting as a motor.

2. The hydraulic system of claim 1 wherein the regeneration valve includes at least a first position in which fluid is substantially prevented from passing through the regeneration valve, and a second position wherein the regeneration valve provides a fluid connection between the cap side fluid connection and the rod side fluid connection, and fluid pressure from hydraulic fluid within the hydraulic system is applied to the regeneration valve to move the valve from at least one of the first to the second position and the second to the first position.

3. The hydraulic system of claim 2 wherein fluid pressure is applied to move the regeneration valve from the first position to the second position.

4. The hydraulic system of claim 2 further comprising an electro-hydraulic control module, the pump including a swash plate, the control module including a control module valve, flow through control module valve resulting in movement of the swash plate to vary the flow rate of the pump, the electro-hydraulic control module further including at least one fluid connection adapted to selectively actuate the regeneration valve.

5. The hydraulic system of claim 1 wherein the regeneration valve is operable in response to a preset minimum pressure differential.

6. The hydraulic system of claim 1 further including a charge circuit, and a fluid connection from the charge circuit to the regeneration valve, the regeneration valve being actuatable in response to fluid pressure from the charge circuit through the fluid connection.

7. The hydraulic system of claim 1 further including at least one solenoid in conjunction with the at least one regeneration valve, the solenoid being disposed and configured to actuate in response to a signal from the controller.

8. The hydraulic system of claim 7 including at least two regeneration valves, and further comprising a hydraulic fluid source and a makeup hydraulic circuit disposed to provide selective flow between the cap side fluid connection and the hydraulic fluid source, and between the rod side fluid connection and the hydraulic fluid source, at least one of the regeneration valves being fluidly disposed between the makeup hydraulic circuit and the rod chamber, and the other of the regeneration valves being fluidly disposed between the makeup hydraulic circuit and the cap side chamber.

9. The hydraulic system of claim 1 wherein the regeneration valve is a spool type valve.

10. The hydraulic system of claim 1 wherein the regeneration valve is a poppet type valve.

11. The hydraulic system of claim 1 wherein the pump is a variable displacement pump.

12. The hydraulic system of claim 1 wherein the pump is a fixed displacement pump, and the system further comprises a motor coupled to the pump, the motor being adapted to selectively rotate the pump to provide varied flow rate.

13. A hydraulic system comprising:

an actuator having a piston disposed within a cylinder, and a rod extending from the piston and extending out of the cylinder, the piston defining a rod chamber and a cap side chamber within the cylinder, a pump adapted to operate as a pump or as a motor, the pump being adapted to selectively provide varied flow rates, the pump being adapted to selectively deliver pressurized hydraulic fluid to and receive pressurized hydraulic fluid from the chambers of the actuator, movement of the piston relative to the cylinder being dependent upon the selectively varied flow rates, a rod side fluid connection between the pump and the rod chamber, a cap side fluid connection between the pump and the cap side chamber, at least one selectively actuatable regeneration valve disposed to selectively provide flow from the cap side fluid connection to the rod side fluid connection, the regeneration valve including at least a first position in which fluid is substantially prevented from passing through the regeneration valve, and a second position wherein the regeneration valve provides a fluid connection between the cap side fluid connection and the rod side fluid connection, a controller that controls the selectively varied flow rate of the pump in response to a commanded motion and relative positions of the piston and cylinder, the controller being configured to cause the actuation of the regeneration valve during a retraction of the piston into the cylinder when the pump is acting as a motor, at least one selectively actuatable cross-over relief valve disposed to selectively provide flow from at least one of the cap side fluid connection to the rod side fluid connection and the rod side fluid connection to the cap side fluid connection, the cross-over relief valve being actuatable to provide flow from the cap side fluid connection to the rod side fluid connection in response to a minimum fluid pressure of hydraulic fluid flow within the cap side fluid connection, and actuatable to provide flow from the rod side fluid connection to the cap side fluid connection in response to a minimum pressure of hydraulic fluid flow within the rod side fluid connection, and a hydraulic fluid source and a makeup hydraulic circuit disposed to provide selective flow between the cap side fluid connection and the hydraulic fluid source, and between the rod side fluid connection and the hydraulic fluid source.

14. A method of controlling a hydraulic system including an actuator having a piston disposed within a cylinder, and a rod extending from the piston and extending out of the cylinder, the piston defining a rod chamber and a cap side chamber within the cylinder, a pump for delivering pressurized fluid to and receiving pressurized fluid from the chambers of the actuator, a rod side fluid connection between the pump and the rod chamber, and a cap side fluid connection between the pump and the cap side chamber, the method comprising the steps of:

disposing at least one regeneration valve between the cap side fluid connection and the rod side fluid connection, the regeneration valve being movable between at least a first position wherein flow through the valve is substantially prevented, and a second position wherein flow is permitted from the cap side fluid connection to the rod side fluid connection, controlling the flow rate of the pump in response to relative positions of the piston and cylinder and a commanded motion of the actuator, and actuating the regeneration valve to move to its second position only when a retraction of the actuator is commanded and the pump is acting as a motor.

15. The method of claim 14 wherein the actuating step includes hydraulically actuating the regeneration valve.

16. The method of claim 15 wherein the actuating step further includes the step of connecting a hydraulic pressure differential across the regeneration valve, the regeneration valve being actuatable in response to a minimum pressure differential across the regeneration valve.

17. The method of claim 15 wherein the hydraulically actuating step includes providing hydraulic pressure from a charge circuit to actuate the regeneration valve.

18. The method of claim 14 wherein the step of actuating the regeneration valve includes the step of actuating a solenoid associated with the at least one regeneration valve to move the regeneration valve to its second position.

19. The method of claim 18 wherein the actuating step includes a step of actuating at least two regeneration valves to move the regeneration valves to their respective second positions only when a retraction of the actuator is commanded and the pump is acting as a motor.

20. A method of controlling a hydraulic system including an actuator having a piston disposed within a cylinder, and a rod extending from the piston and extending out of the cylinder, the piston defining a rod chamber and a cap side chamber within the cylinder, a pump for delivering pressurized fluid to and receiving pressurized fluid from the chambers of the actuator, the pump being adapted to operate as a pump or a motor, a rod side fluid connection between the pump and the rod chamber, and a cap side fluid connection between the pump and the cap side chamber, the method comprising the steps of:

disposing at least one regeneration valve between the cap side fluid connection and the rod side fluid connection, the regeneration valve being movable between at least a first position wherein flow through the valve is substantially prevented, and a second position wherein flow is permitted from the cap side fluid connection to the rod side fluid connection, controlling the flow rate of the pump in response to relative positions of the piston and cylinder and a commanded motion of the actuator, operating the pump as a pump when an extension of the actuator is commanded and a force exerted by a load is in the opposite direction of the commanded extension, operating the pump as a motor when an extension of the actuator is commanded and the force exerted by the load is in the same direction as the commanded retraction, operating the pump as a pump when a retraction of the actuator is commanded and the force exerted by the load is in the opposite direction of the commanded extension, operating the pump as a motor when a retraction of the actuator is commanded and a force exerted by a load is in the same direction as the commanded retraction, and actuating the regeneration valve to move to its second position only when the retraction of the actuator is commanded and the pump is acting as a motor.

* * * * *